US009777955B2

(12) United States Patent
Hardy et al.

(10) Patent No.: US 9,777,955 B2
(45) Date of Patent: Oct. 3, 2017

(54) COLLAPSIBLE INSULATING DEVICE

(71) Applicant: RTC Industries, Inc., Rolling Meadows, IL (US)

(72) Inventors: Stephen N. Hardy, Wadsworth, OH (US); Gideon Schlessinger, Rolling Meadows, IL (US); Fred Geiger, Rolling Meadows, IL (US); Julio Lozano, Rolling Meadows, IL (US)

(73) Assignee: RTC Industries, Inc., Rolling Meadows, IL (US)

( * ) Notice: Subject to any disclaimer, the term of this patent is extended or adjusted under 35 U.S.C. 154(b) by 0 days.

(21) Appl. No.: 15/095,978

(22) Filed: Apr. 11, 2016

(65) Prior Publication Data

US 2016/0223243 A1 Aug. 4, 2016

Related U.S. Application Data

(63) Continuation-in-part of application No. 14/535,137, filed on Nov. 6, 2014, now Pat. No. 9,310,117.
(Continued)

(51) Int. Cl.
*F25C 5/18* (2006.01)
*B65D 6/24* (2006.01)
*B65D 81/38* (2006.01)

(52) U.S. Cl.
CPC ..... *F25C 5/182* (2013.01); *B65D 11/1873* (2013.01); *B65D 81/3806* (2013.01)

(58) Field of Classification Search
CPC ..... F25C 5/182; A47F 3/004; B65D 11/1873; B65D 81/3806; F25D 3/06
(Continued)

(56) References Cited

U.S. PATENT DOCUMENTS 1,735,082 A * 11/1929 Martin, Jr. ..... F25D 3/14 229/103.11
2,178,778 A 11/1939 Curry
(Continued)

FOREIGN PATENT DOCUMENTS

CA 2567510 A1 6/2007
GB 142565 A 5/1920
(Continued)

OTHER PUBLICATIONS

Oct. 31, 2016—(AU) Examination Report—App 2014346657.
(Continued)

*Primary Examiner* — Robert J Hicks
(74) *Attorney, Agent, or Firm* — Banner & Witcoff, Ltd.

(57) ABSTRACT

A portable insulating device kit may be configured to fit within a smaller container for easier shipment. In one example, the assembly may include a base, a top wall having an opening, an inner liner configured to extend into the opening of the top wall to form an interior cavity defining a volumetric storage capacity and an exterior wall. The container can have a flat configuration defining a length, height, and width. The base, the top wall, the inner liner, and the exterior wall may be configured to be assembled into a portable insulating device. The volume of the container may be less than the volumetric storage capacity of the assembled portable insulating device, and the base, the inner liner, and the exterior wall are configured to be detached from one another and shipped in the container.

23 Claims, 40 Drawing Sheets

Related U.S. Application Data

(60) Provisional application No. 62/267,803, filed on Dec. 15, 2015, provisional application No. 62/017,728, filed on Jun. 26, 2014, provisional application No. 61/900,925, filed on Nov. 6, 2013.

(58) Field of Classification Search
USPC ..... 220/723, 720, 592.03, 592.01, 9.2, 9.1, 220/4.09, 4.08, 4.33, 4.28, 592.02, 915.2, 220/9.3, 915.1; 62/372, 371, 457.5, 62/457.4, 457.2, 457.1; 206/600, 386, 206/577, 223, 216
See application file for complete search history.

(56) References Cited

U.S. PATENT DOCUMENTS

| | | | | |
|---|---|---|---|---|
| 2,575,191 | A | | 11/1951 | Seipp |
| 2,866,251 | A | | 12/1958 | Ford |
| 3,347,060 | A | | 10/1967 | Barkan |
| 4,514,993 | A | | 5/1985 | Johnson |
| 4,850,506 | A | * | 7/1989 | Heaps, Jr. ..... B65D 77/061 206/386 |
| 5,397,000 | A | | 3/1995 | Holte et al. |
| 5,490,396 | A | | 2/1996 | Morris |
| 5,931,583 | A | | 8/1999 | Collie |
| 6,000,549 | A | * | 12/1999 | Perkins ..... B65D 77/061 206/596 |
| 2007/0045311 | A1 | | 3/2007 | Wang |
| 2010/0011798 | A1 | | 1/2010 | Robertson |
| 2010/0012550 | A1 | | 1/2010 | Dedmon et al. |
| 2010/0270317 | A1 | | 10/2010 | Kieling et al. |
| 2011/0272419 | A1 | | 11/2011 | Vanderberg et al. |
| 2014/0260412 | A1 | | 9/2014 | Keast et al. |

FOREIGN PATENT DOCUMENTS

| | | | |
|---|---|---|---|
| GB | 741348 | A | 11/1955 |
| NL | 83368 | C | 6/1956 |
| WO | 2011150414 | A1 | 12/2011 |

OTHER PUBLICATIONS

May 4, 2015—(PCT) International Search Report and Written Opinion—App PCT/US2014/06440.

Jun. 12, 2017—(WO) ISR and Written Opinion—App. No. PCT/US2017/026925.

* cited by examiner

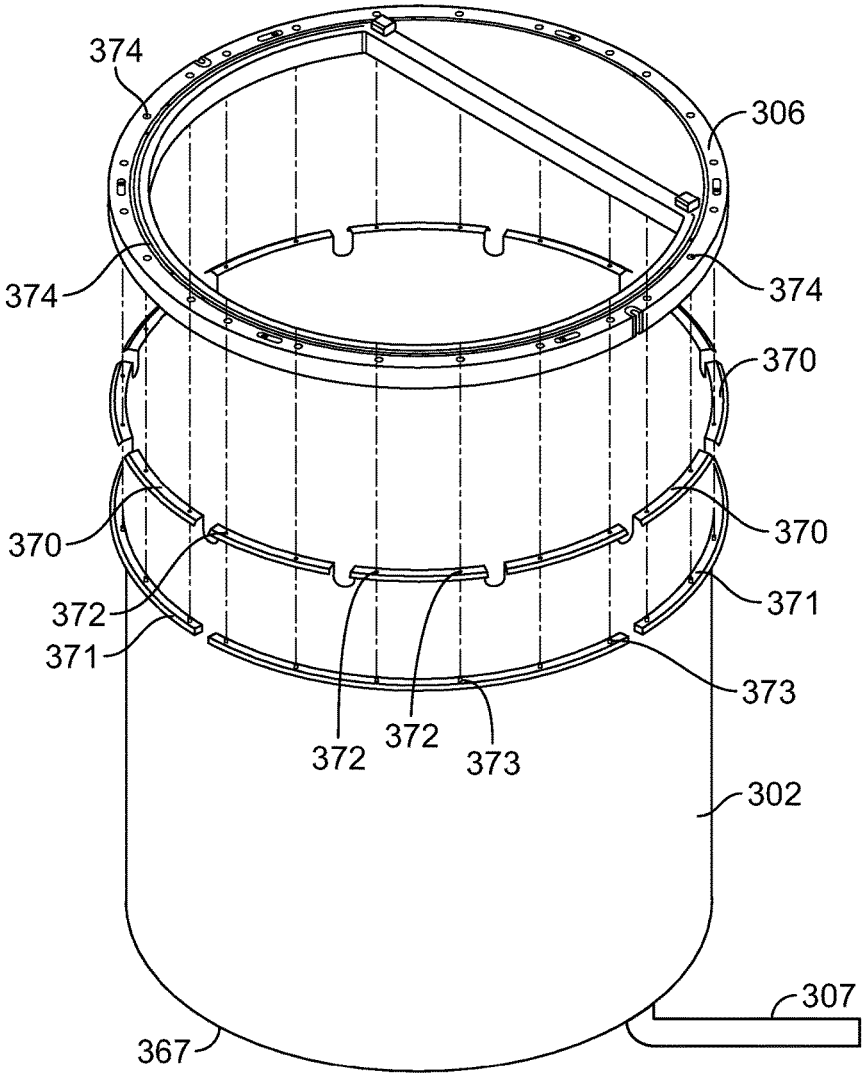
FIG. 17F
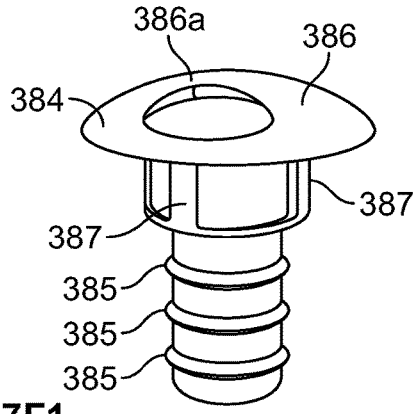
FIG. 17F1

COLLAPSIBLE INSULATING DEVICE

CROSS REFERENCE TO RELATED APPLICATIONS

This application claims benefit to U.S. Application No. 62/267,803, filed on Dec. 15, 2015, and is a continuation-in-part application of U.S. application Ser. No. 14/535,137, filed Nov. 6, 2014, which claims benefit to U.S. Provisional Application Nos. 62/017,728, filed Jun. 26, 2014, and 61/900,925, filed Nov. 6, 2013. All of the above applications are incorporated fully herein by reference.

FIELD

The exemplary embodiments relate generally to a modular ice barrel that is shipped in component form and minimizes shipping volume. Once the ice barrel is delivered to the final destination, individuals can expediently assemble the components. As a result of the reduced volume and assembly capability, shipping and transportation costs are minimized and greater amounts of ice barrels delivered in a single shipment can be increased.

BACKGROUND

Ice barrels can be shipped fully assembled to the point of use from a distant location. This can result in empty space in the interior cavity of the barrel to be shipped along with the fully assembled barrel. An example shipping container may be roughly 24 inches by 24 inches by 24 inches with a total volume capacity of roughly 13,824 cubic inches. Assembled ice barrels can exceed the volume capacity of a standard shipping container. As a result of wasted space and size limitations, the cost of shipping a fully assembled barrel may be greater than the cost of the barrel itself. Although injection molding can be used in conjunction with the examples disclosed herein, injection molded components may add to the weight of the barrel adding to the cost of shipment. Also when turning over a heavier weight barrel to empty water and ice from the interior cavity, in certain instances may lead to injury due to the weight of the barrel.

SUMMARY

An example portable ice barrel may include one or more of an exterior barrel wall, an interior barrel wall, and insulative layer positioned in between the exterior barrel wall and the interior barrel wall. In one example, the interior barrel wall can comprise an expandable bladder made of flexible material and the expandable bladder can have an open end, a closed end, and can be adapted to expand from a collapsed position into an expanded position. In the collapsed position, the bladder can be folded into a compact position to reduce the volume of the interior of the bladder to minimize shipping volume. Other components of the example portable ice barrel such as the lid, top rim, bottom rim, and base may also incorporate living hinges to allow the components to be collapsed further reducing the shipping volume.

In another example, a portable ice barrel can include a plurality of sections which can be configured to form a cylindrical insulation layer. The cylindrical insulation layer can form an opening and an inner liner can extend into the opening of the cylindrical insulation layer to form an interior barrel cavity for receiving ice and the desired contents. In one example, the plurality of sections can be disassembled to minimize the shipping volume.

In yet another example, a portable ice barrel may include one or more of an exterior barrel wall, an interior barrel wall, and insulative layer positioned in between the exterior barrel wall and the interior barrel wall. The interior barrel wall can comprise an expandable bladder made of flexible material and the expandable bladder can have an open end, a closed end, and can be adapted to expand from a collapsed position into an expanded position. In the collapsed position, the bladder can be folded into a compact position to reduce the volume of the interior of the bladder to minimize shipping volume. After assembly of the individual components, insulative material can be injected into a gap between the exterior wall inside surface and the bladder exterior surface to form an insulative layer there between.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

FIGS. 15A-15F depict views of another example portable ice barrel.

DETAILED DESCRIPTION

Figure 1:
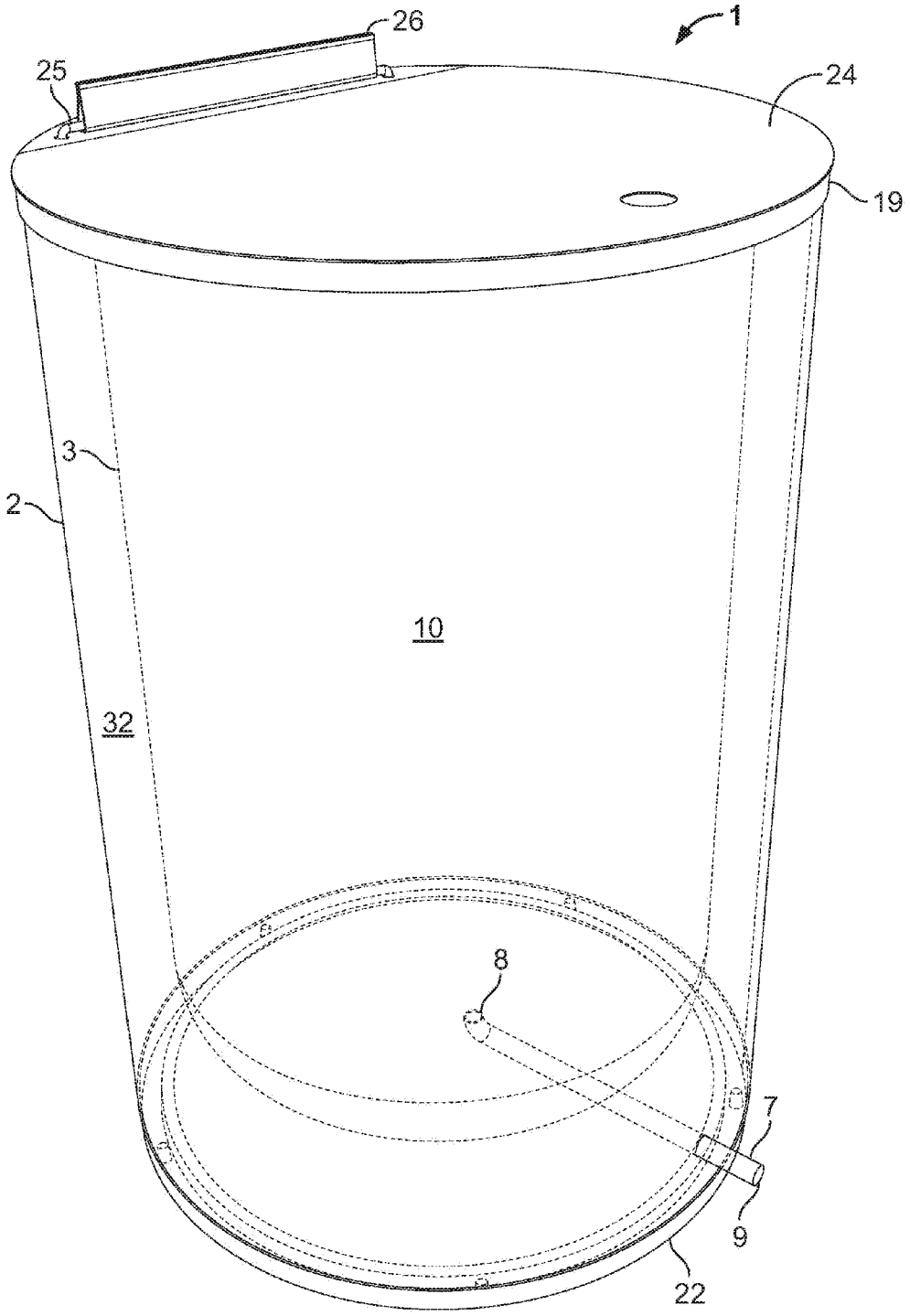
FIG. 1 depicts a top, left perspective view of aspects of an example portable ice barrel.

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "front," "back," "rear," "side," "forward," "rearward," "backward," "height," "width," "length," "volume," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the disclosure.

Referring to FIGS. 1-8, in an embodiment, a portable ice barrel 1 can include an exterior barrel wall 2, an interior barrel wall 3, and insulative material 4 positioned in between the exterior barrel wall 2 and the interior barrel wall 3. The interior barrel wall 3 can be an expandable bladder 3 made of a flexible material. Example flexible materials include but are not limited to flexible plastics, including flexible polyvinyl chloride (PVC) films. In an embodiment, the expandable bladder may be configured to expand from a collapsed position into an expanded position. For example, in the collapsed position, the bladder can be folded into a compact position to reduce the volume of the interior of the bladder. In an example embodiment, in the collapsed position, the expandable bladder can resemble a folded bag. In addition, for example, in the expanded position, the bladder can be expanded to define a cavity of increased volume within the interior of the bladder. The expandable bladder can include an open end 5 and a closed end 6 and a bladder body segment 15 extending between the open end and the closed end. The expandable bladder can include a bladder interior surface 16 and a bladder exterior surface 17. In an embodiment, the expandable bladder can include a top drape 18 extending from a perimeter of the open end. The top drape can be configured to fold toward the exterior surface 17 proximate the open end.

In an embodiment, the expandable bladder can be configured in the expanded position within the exterior barrel wall 2 to define an interior barrel cavity 10 such that the closed end of the bladder can contain ice within the barrel cavity and the open end allows access to the barrel cavity. For example, the open end of the expandable bladder can be secured proximate to a top edge of the exterior wall 2, and the body segment of the expandable bladder can be positioned within the exterior barrel wall 2. In an example embodiment, the body segment of the expandable bladder can be cylindrical in shape when the expandable bladder is in the expanded position. In one example, an inner diameter of the body segment can be between about 18 inches to about 24 inches. In another example, a diameter of the exterior wall can be about 1 inch to about 5 inches greater than the diameter of the body segment of the expandable bladder.

In one example, the exterior barrel wall 2 includes an exterior wall outside surface 11, an exterior wall inside surface 12, an exterior wall top edge 13, and an exterior wall bottom edge 14. In an embodiment, the exterior barrel wall 2 is constructed of a semi-rigid material. Example semi-rigid materials include but are not limited to styrene, polyethylene, and vinyl. In one example, the exterior wall outside surface can be suitable for printing thereon. The exterior barrel wall can provide structural support for the interior barrel wall and/or the insulative material. In an embodiment, the exterior barrel wall can be constructed of, for example, a flexible sheet made of semi-rigid material. Example flexible sheets made of semi-rigid material include, for example, styrene sheet, polyethylene sheet, and vinyl sheet. The flexible sheet of rigid material can be flexed into the desired shape of the exterior barrel wall so that a sheet outside surface 11, sheet inside surface 12, sheet top edge 13, and sheet bottom edge 14 become the exterior wall outside surface 11, the exterior wall inside surface 12, the exterior wall top edge 13, and the exterior wall bottom edge 14 of the exterior barrel wall 2. For example, a sheet right side edge 29 can be folded over a sheet left side edge 30, or vice versa, and secured at a seam 31 to form a cylinder. Example shapes of the exterior barrel wall include cylindrical, rectangular, and oval.

In an embodiment, the insulative material can be a foam material, including for example rigid expanded polystyrene foam material. In an embodiment, the insulative material can provide structural support for the exterior barrel wall and or the interior barrel wall. In and embodiment, the insulative material can have an R-value of at least 5. In an embodiment, the insulative material can be injected into a gap 32 between the exterior wall inside surface and the bladder exterior surface to form an insulative layer 4 there between.

In an embodiment, the portable ice barrel can include a top rim 19 secured to the exterior wall top edge. In an embodiment, the top rim can include a top rim channel 20 defined within the top rim. In an embodiment, the top rim can include rim cones 21 positioned in the rim channel. In an embodiment, the rim cones can be spaced an equal distance from each other within the rim channel. In an embodiment, at least a portion of the top drape 18 of the expandable bladder is draped over a portion of the exterior wall top edge and the top rim is positioned such that the portion of the top drape and the portion of the exterior wall top edge are within the top rim channel so that the top rim channel creates a friction fit holding the top drape in position against the exterior wall top edge.

In an embodiment, the portable ice barrel can include a bottom rim 22 secured to the exterior wall bottom edge 14. In an embodiment, the bottom rim can include a bottom rim channel 23 defined within the bottom rim. In an embodiment, the bottom rim can include rim cones 21 positioned in the bottom rim channel. In an embodiment, the rim cones can be spaced an equal distance from each other within the bottom rim channel. In an embodiment, at least a portion of the exterior wall bottom edge is positioned within the bottom rim channel to create a friction fit between the bottom rim and the exterior wall bottom edge to hold the bottom rim in position against the exterior barrel wall.

In an embodiment, the expandable bladder includes a drain pipe 7 secured proximate the closed end of the bladder 3. The drain pipe can include a proximal end 8 and a distal end 9. The drain pipe proximal end can be secured to the closed end of the expandable bladder. In an embodiment, the drain pipe can be constructed of a plastic material and the proximal end 8 can be secured to the expandable bladder by a suitable plastic welding technique. For example, the drain pipe can be constructed of rigid PVC and welded to the bladder by high frequency welding, including radio frequency heat sealing. In an embodiment, the drain pipe is configured such that the drain pipe distal end extends through the exterior barrel wall. In an embodiment, a drain pipe valve can be secured to the distal end of the drain pipe. Example drain pipe valves can include a one-way check valve or a ball valve.

Figure 7:
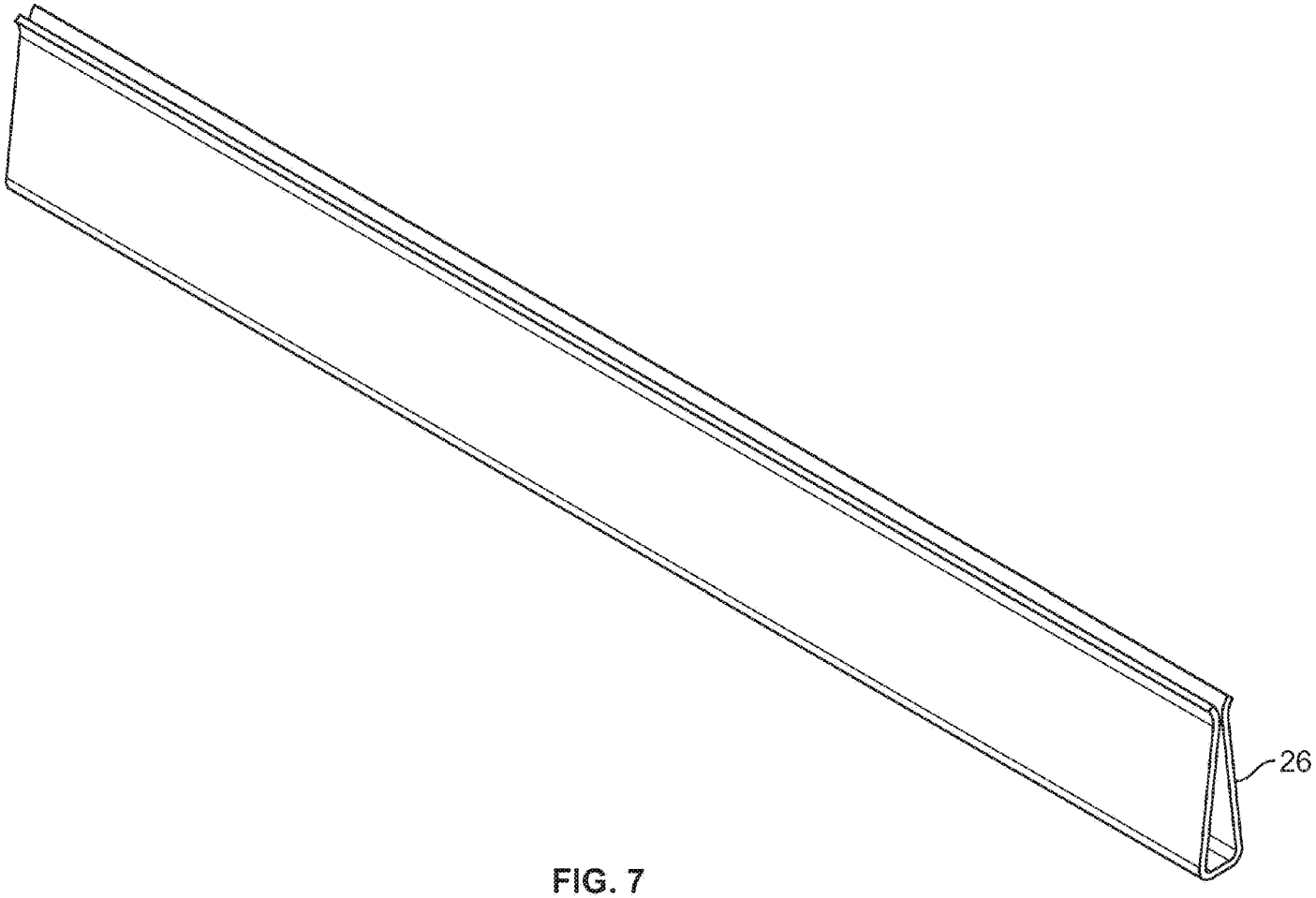
FIG. 7 depicts a top, right perspective view of aspects of an example sign holder extrusion of a portable ice barrel.

In an embodiment, the portable ice barrel includes a lid 24 configured to removably cover the interior barrel cavity. In an embodiment, the lid can include a lid hinge 27 and lid handle 28. In an embodiment, the lid handle is a hold defined in the lid 27. The lid can be constructed of, for example, clarified polypropylene or PEGT. In an embodiment, the portable ice barrel can include a sign holder 25 and a sign holder extrusion 26 configured to hold a sign. In an embodiment, as depicted in FIG. 7, the sign holder extrusion 26 is in the form of a clamp. In an embodiment, the portable ice barrel includes a barrel base and casters (not shown). In an embodiment, the barrel base is in the form of a tray on which the bottom of the portable ice barrel can be placed. The barrel base can be the same shape as the portable ice barrel. In an embodiment, casters are secured to the underside of the barrel base to facilitate moving the portable ice barrel by pushing the barrel while it is positioned on the barrel base. In another embodiment, the casters are secured to a collapsible barrel cooler bottom rim with a living hinge by a plurality of support tubes.

Figure 8A:
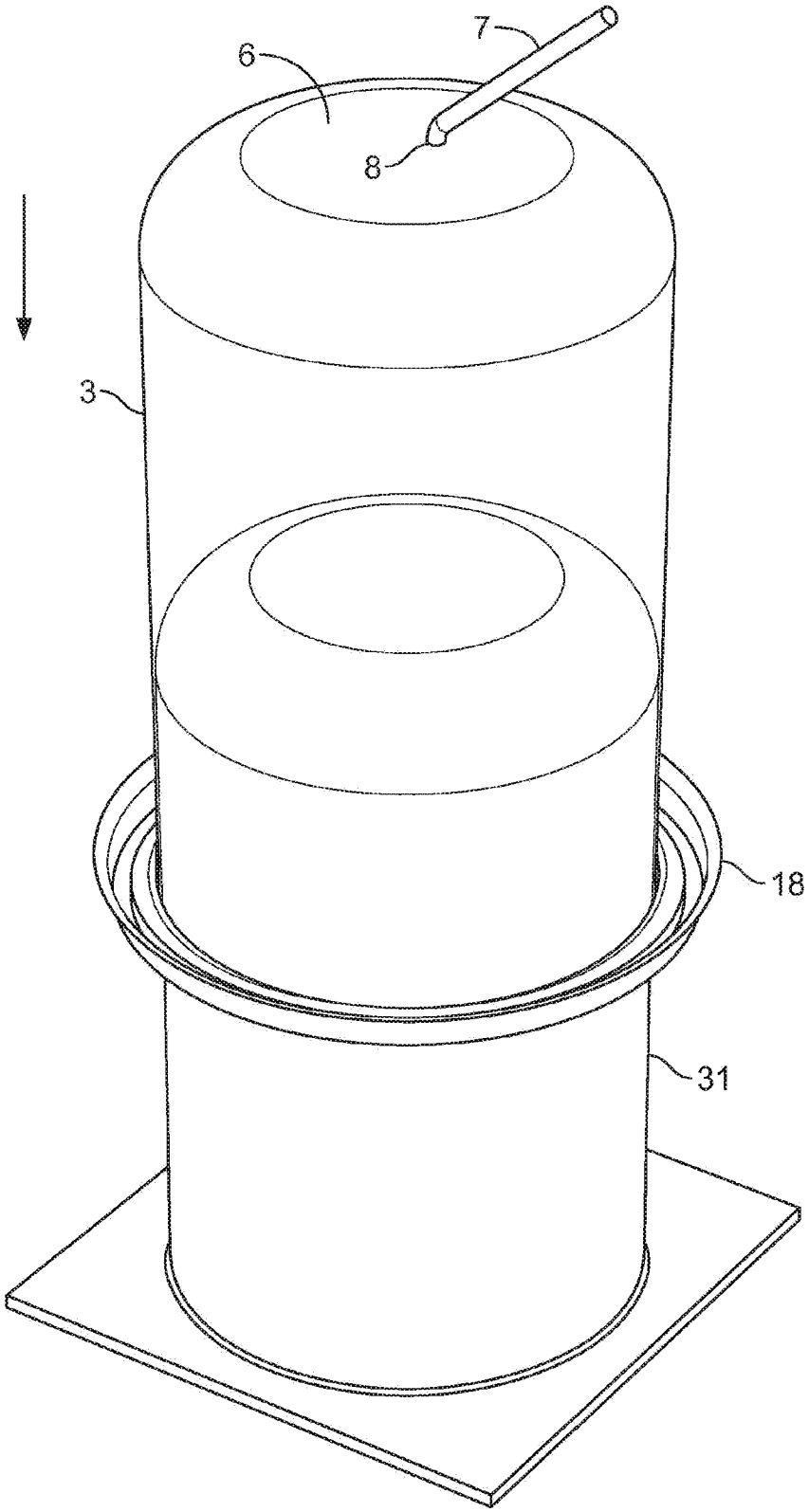
FIG. 8A depicts a top, front perspective view of aspects of example components used for assembly of a portable ice barrel.
Figure 8B:
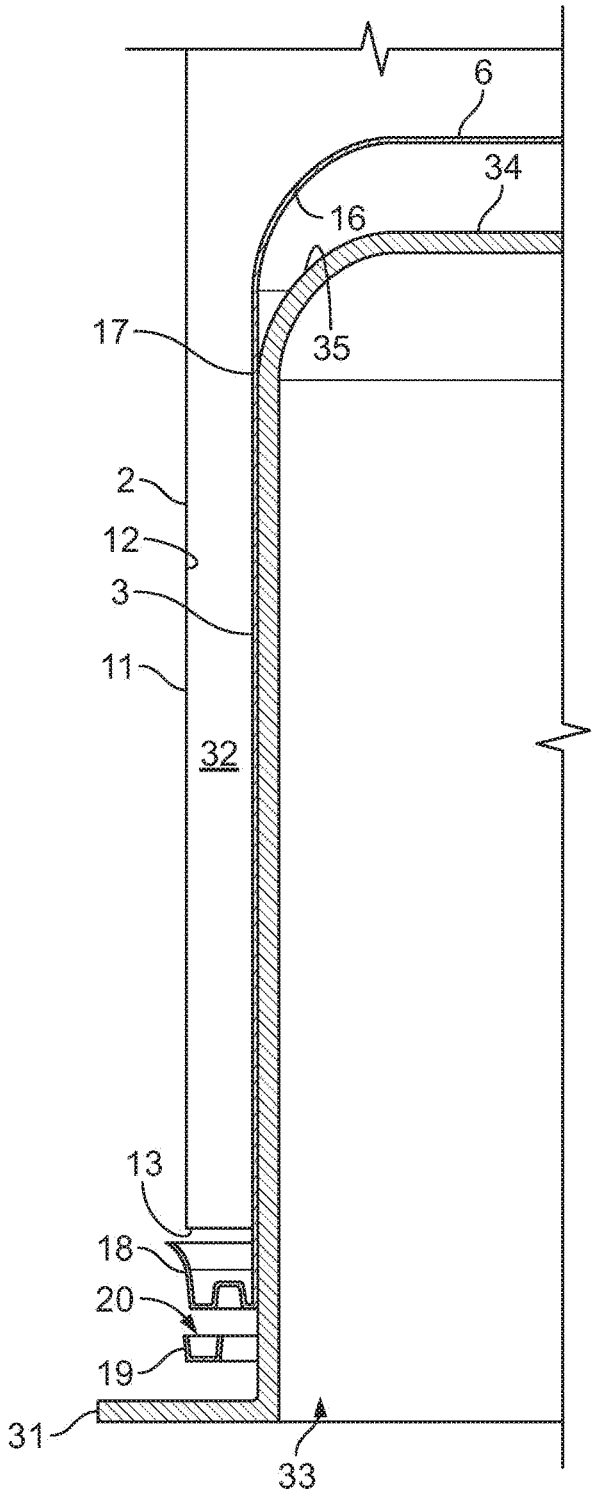
FIG. 8B depicts a partial side cross-sectional view of aspects of example components used for assembly of a portable ice barrel.
Figure 8C:
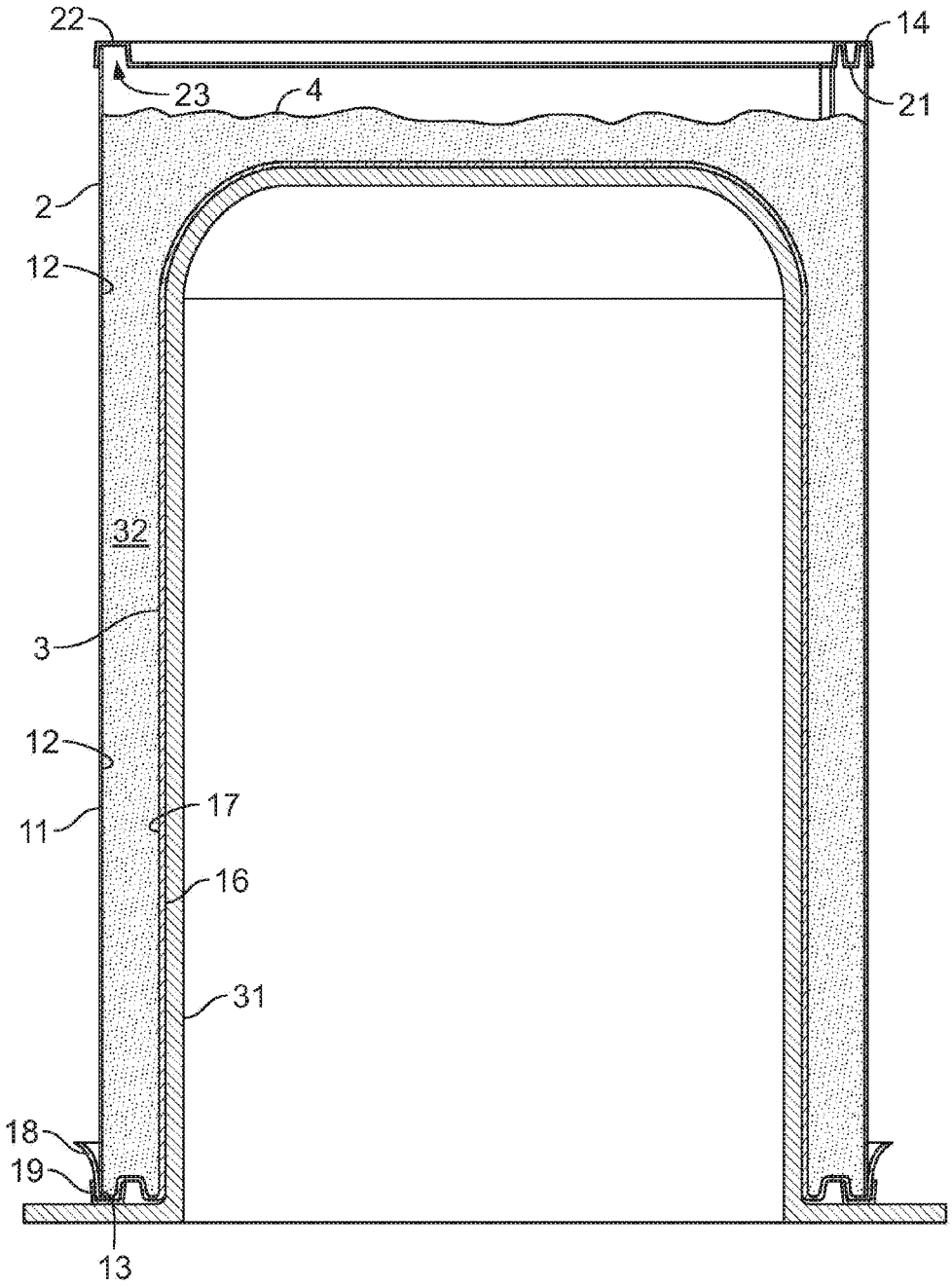
FIG. 8C depicts a side cross-sectional view of aspects of example components used for assembly of a portable ice barrel.
Figure 8D:
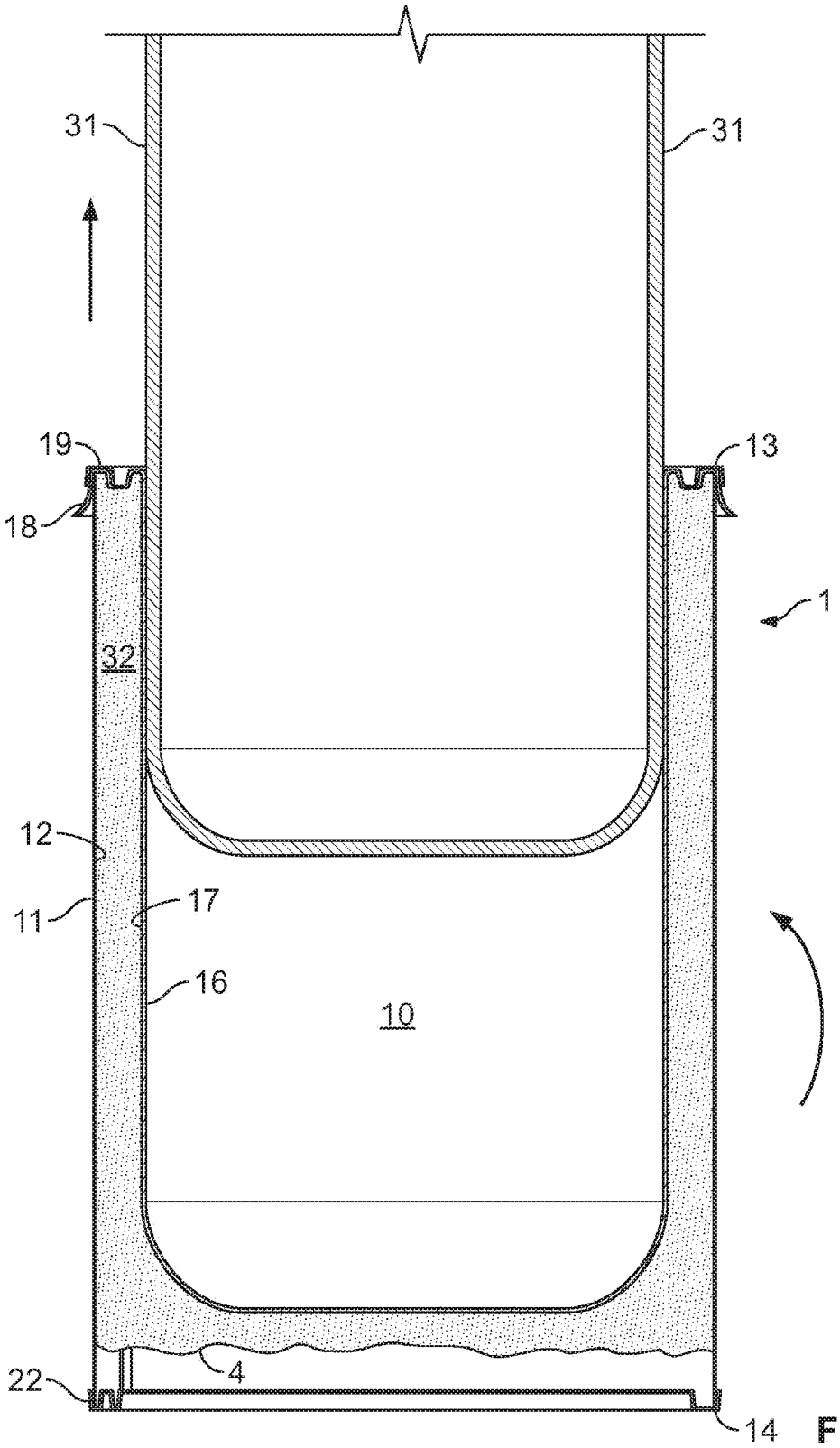
FIG. 8D depicts a side cross-sectional view of aspects of example components used for assembly of a portable ice barrel.

The portable ice barrel of the instant disclosure can be assembled according to various methods including steps and components disclosed herein. In an embodiment, a barrel form 31 is used to assemble the portable ice barrel of the current disclosure. In an embodiment, the barrel form 31 is shaped in the shape desired for the interior barrel cavity 10. In an embodiment, the expandable bladder can take the shape of the barrel form 31 when the bladder is expanded and positioned over the form 31 to cover the form 31 with the interior surface of the bladder. In an embodiment, the open end of the expandable bladder is expanded and placed over the barrel form as depicted in FIG. 8A. In an embodiment, the bladder is pulled down over the form so that the bladder open end is positioned proximate the form open end 33 and the bladder closed end is positioned proximate the form closed end 34 and 35, such as shown by example in FIG. 8C.

In an embodiment, a top rim is positioned over the barrel form 31 so that the top rim encircles the form 31. In another embodiment, a collapsible top rim with a living hinge is positioned over a collapsible heat stake plate with a living hinge. In an embodiment, the bladder top drape 18 is positioned in the top rim channel 20 so that a portion of the top drape covers a portion of the inside surface of the top rim channel 20, such as shown by example in FIG. 8C. In an embodiment, an exterior barrel wall 2 can be positioned around the expandable bladder 3 covering the barrel form 31 so that a gap 32 is defined in between an inside surface 12 of the exterior barrel and the bladder exterior surface 17. In an embodiment, the exterior barrel wall can be formed by flexing and welding a flexible sheet as described above before the exterior barrel wall is positioned around the interior barrel wall. In addition, in an embodiment, the logos and/or graphics can be printed on the outside surface of the sheet prior to forming the sheet into the exterior barrel wall. In an embodiment, the exterior wall top edge 13 is positioned in the top rim channel and in contact with a portion of the top drape of the expandable bladder which is also positioned in the top rim channel so as to form a friction fit seal between the top drape 18 and exterior wall top edge 13. In an embodiment, an adhesive can be used to adhere the top drape of the bladder to the top rim channel and/or adhere the exterior wall top edge to the top drape of the expandable bladder. In an embodiment, the distal end of the drain pipe can be positioned to extend through a hole defined in the exterior wall. In an embodiment, a bottom rim can be positioned over the exterior wall bottom edge, such as shown by example in FIG. 8C. In an embodiment, the dimensions of the exterior barrel wall 2 and the interior barrel wall 3 can be configured so that the gap 32 defined in between the exterior wall inside surface 12 and the bladder exterior surface 17 can be about 1 inch to about 5 inches. In an embodiment, insulative material is inserted into the gap through the bottom of the barrel to form the insulative layer 4. In an embodiment, the insulative layer covers the bladder body segment. In an embodiment, the insulative layer covers the bladder exterior surface at the closed end of the bladder. In an embodiment, once the insulative layer is in place or cures, the barrel form can be removed to expose interior barrel cavity. In an embodiment, the portable ice barrel is rotated from an upside-down position shown in FIG. 8C into an upright position shown in FIG. 8D before the barrel form is removed from the interior barrel cavity. In an embodiment, the lid, sign holder, and sign extrusion can be secured to the top rim. In an embodiment, casters can be secured to the underside of a barrel base and the portable ice barrel can be positioned onto the barrel base. In another embodiment, the casters are secured to a collapsible barrel cooler bottom rim with a living hinge by a plurality of support tubes.

Figure 9:
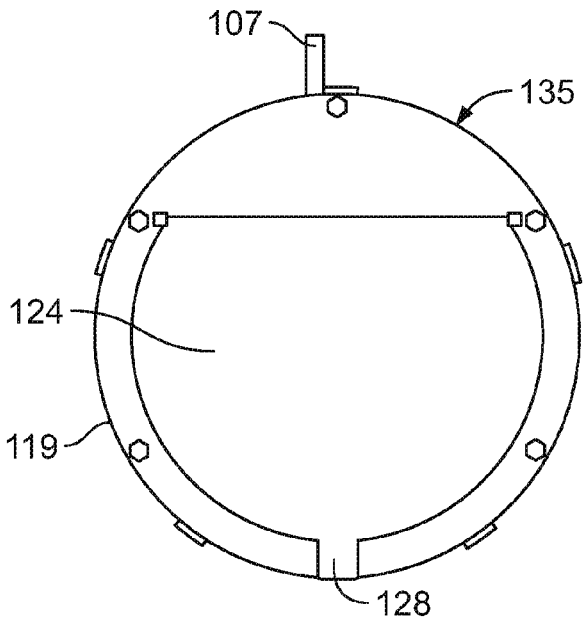
FIG. 9 depicts a top view of another example portable ice barrel.
Figure 10:
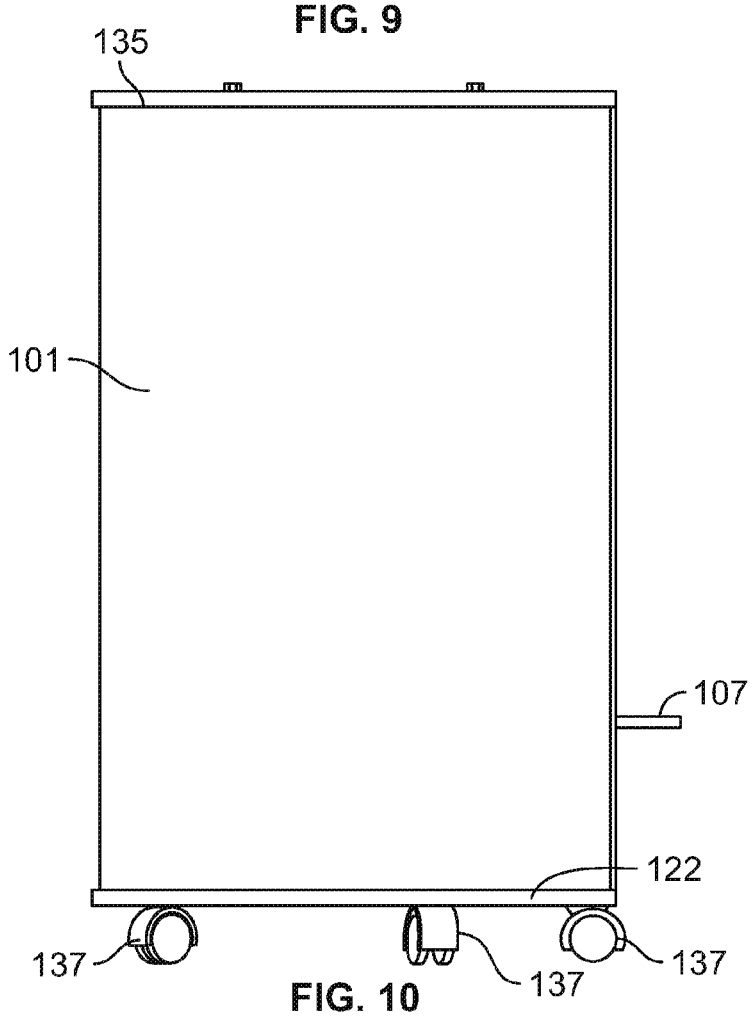
FIG. 10 depicts a side view of the example portable ice barrel of FIG. 9.
Figure 11:
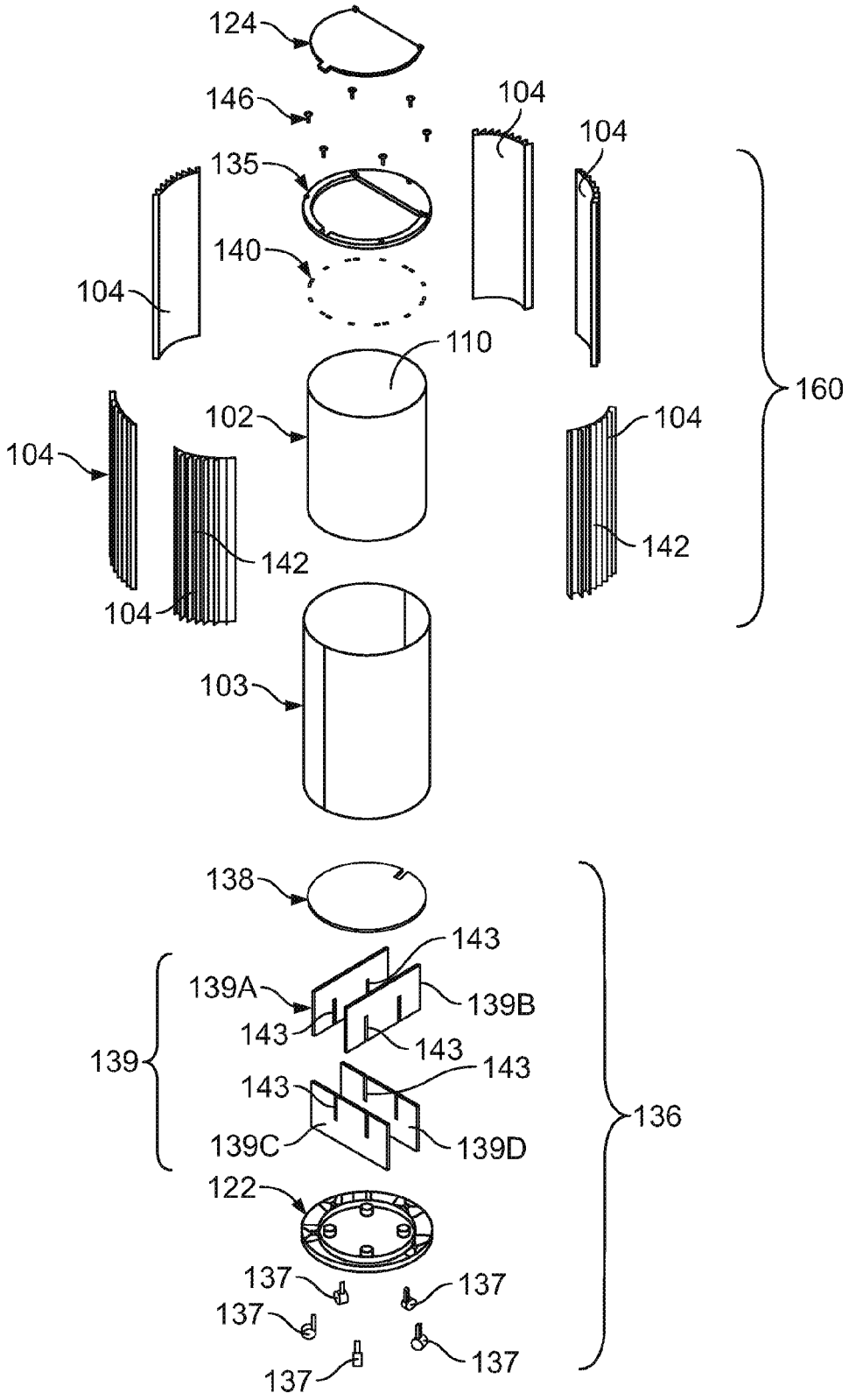
FIG. 11 depicts an exploded perspective view of the example portable ice barrel of FIG. 9.

FIGS. 9-14E depict another example portable ice barrel 101. The portable ice barrel 101 can include similar components as the example depicted in FIGS. 1-8. These components are labeled with like reference numerals in the accompanying drawings but use 100 series reference numerals. In the example shown in FIGS. 9-14F, instead of using insulative material 4, a series of barrel sections or baffles 104, as shown in FIG. 11, are used to provide insulation to the contents of the portable ice barrel 101. In another example, as shown in FIG. 15, an outer and inner layer form a gap of air that provides insulation to the contents of the portable ice barrel 101. FIG. 9 shows a top perspective view of the example portable ice barrel 101, and FIG. 10 shows a side perspective view. The exterior of the portable ice barrel 101 generally includes a top wall 135, a lid 124, a drain pipe 107, an exterior barrel wall 103, and a bottom rim 122 which can be configured to receive a series of wheels 137. The exterior barrel wall 103 can be formed as a graphic panel and can include any name, logo, or symbol depending on the contents and desired advertising. The top wall 135 can have a partial rim 119 and can be configured to receive a lid 124. The lid 124 provides an opening into the interior barrel cavity 110 formed in the portable ice barrel 101, and can be hingedly connected to the top wall 135 by hinge 127. The lid 124 may also include a handle 128, which can be in the form of a projection for opening the lid 124. Additionally the top wall 135 can be formed with a notch 128*a* for receiving the handle 128 of the lid 124. In one example, the lid 124 can be provided with a living hinge (not shown) that separates the lid 124 into two sections such that the lid 124 can be folded into a smaller configuration for easy and compact shipment.

FIG. 11 depicts an exploded perspective view of the portable ice barrel 101 showing both the exterior and interior components of the portable ice barrel 101. In addition to the exterior components described above, the example portable ice barrel 101 can include an insulation layer 160 formed of barrel sections 104, a bladder or liner 102, and a base assembly 136. Like in the example shown in FIGS. 1-8, the liner 102 forms an interior barrel cavity 110 for receiving contents, such as ice and any desired products.

As shown in FIG. 11, the barrel sections 104 are configured to fit under the top wall 135 and between the exterior barrel wall and the liner 102. The barrel sections 104 can each be formed identically. As will be described in further detail below, the barrel sections 104 form the cylindrical insulation layer 160 by trapping air between the liner 102 and the exterior barrel wall 103.

In this example, six barrel sections 104 can be provided. In one example, each of the barrel sections 104 can comprise 30 degrees of the cylinder forming the portable ice barrel 101. However, any number of sections can be provided for the desired insulation and manufacturability. The barrel sections 104 can be provided with a slight curvature such that they form a cylinder when assembled in the portable ice barrel 101. The curvature can be slight enough such that the barrel sections 104 can be shipped in a mostly flat configuration.

Figure 12A:
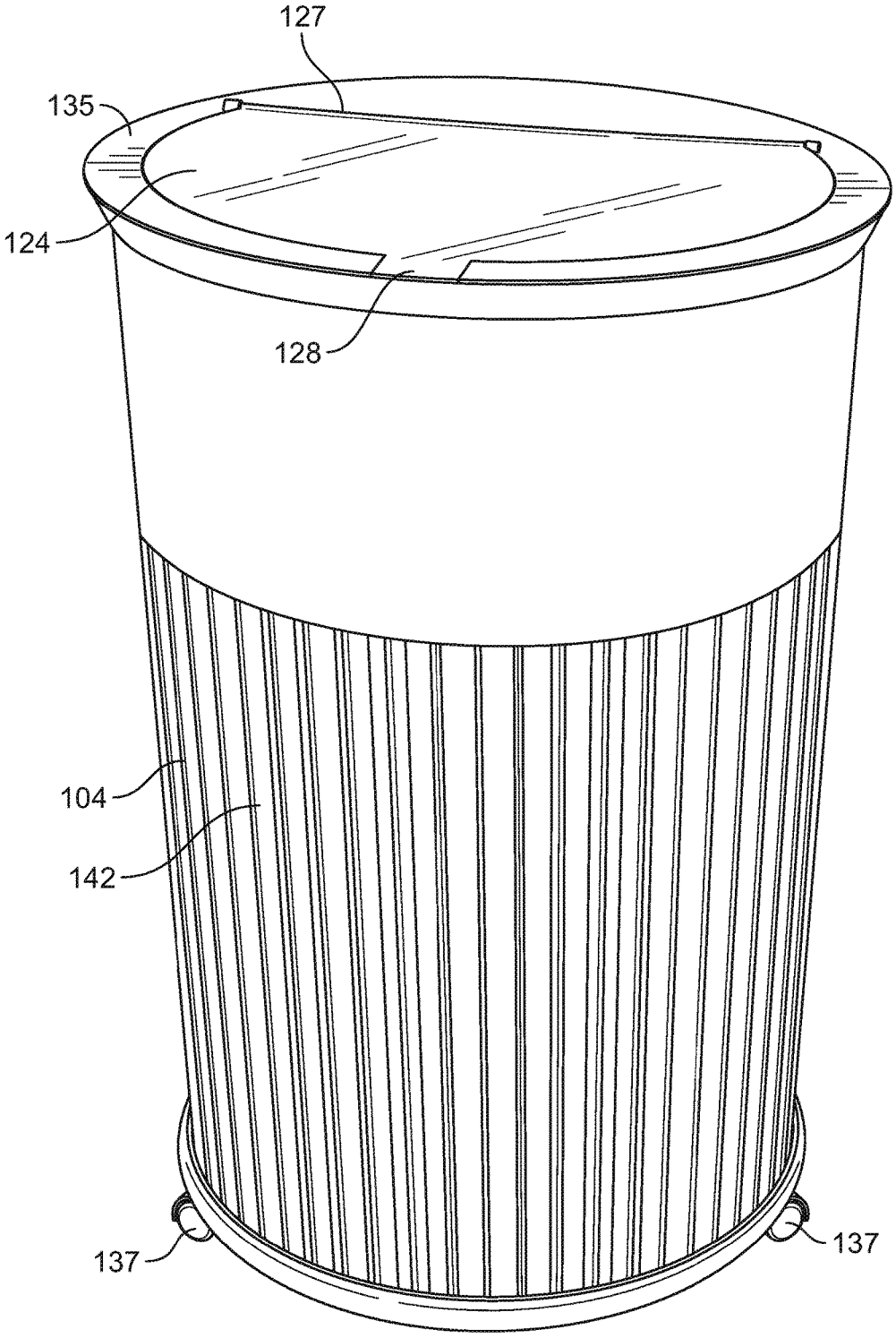
FIG. 12A depicts a perspective view of a partial assembly of the example portable ice barrel of FIG. 9 with a lid in the closed position.
Figure 12B:
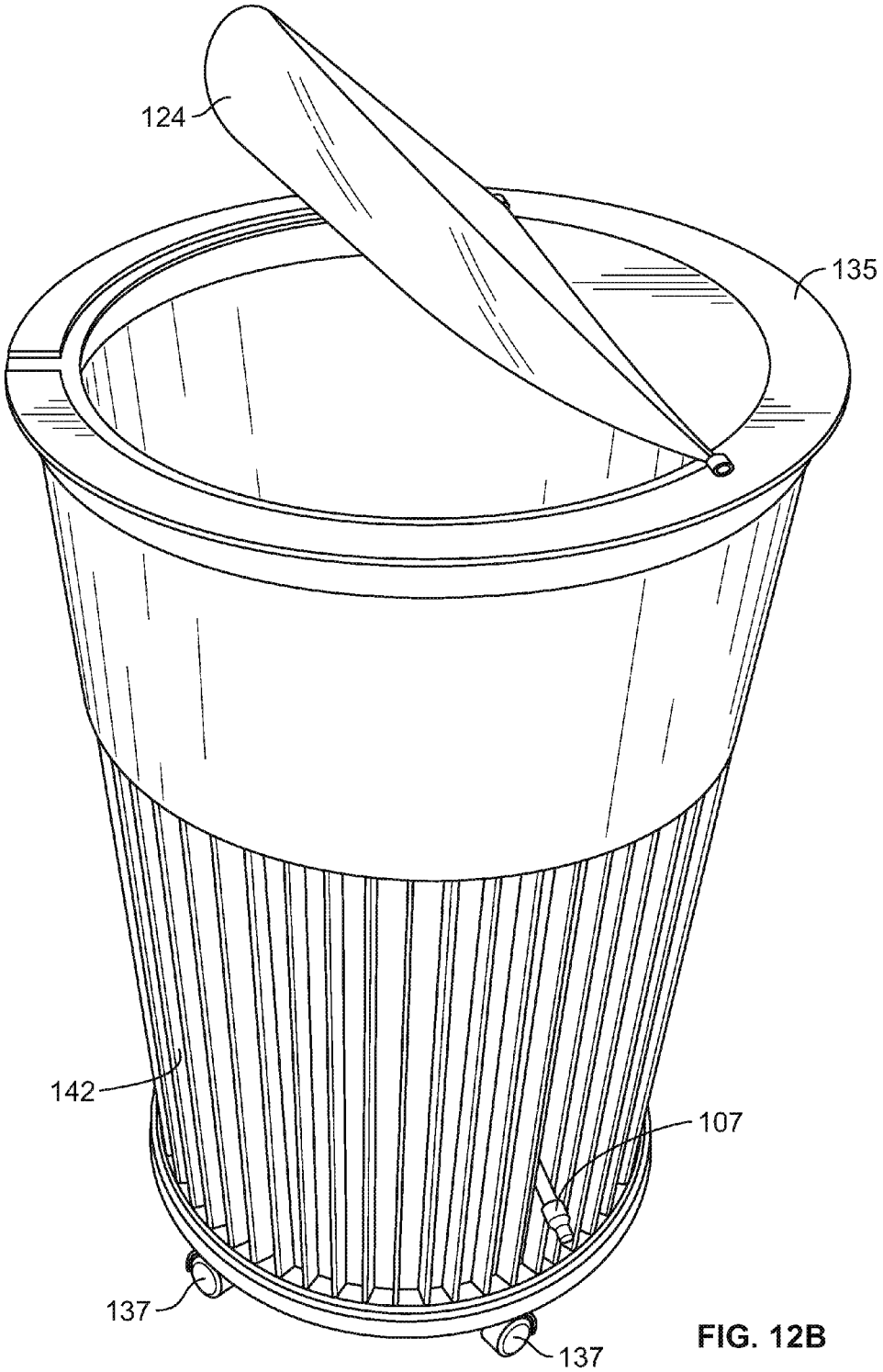
FIG. 12B depicts a perspective view of a partial assembly of the example portable ice barrel of FIG. 9 with a lid in the opened position.
Figure 12C:
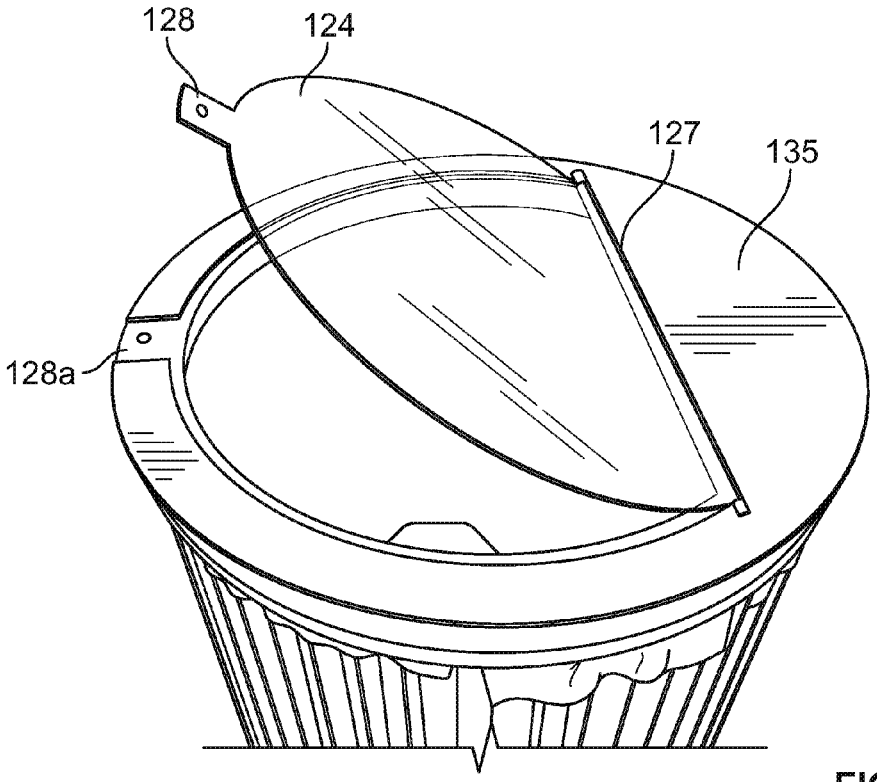
FIG. 12C depicts another perspective view of a partial assembly of the example portable ice barrel of FIG. 9 with a lid in the opened position.
Figure 12D:
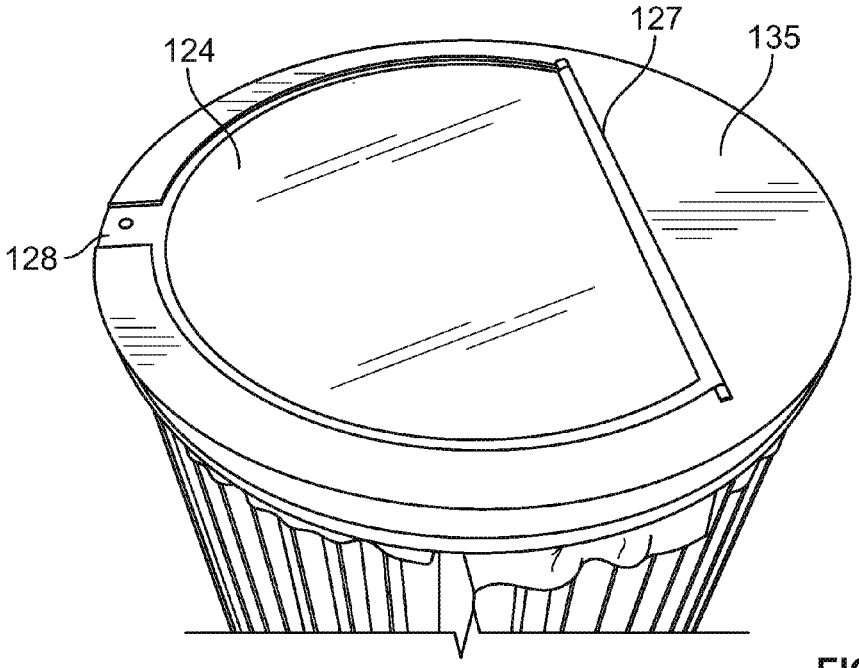
FIG. 12D depicts another perspective view of a partial assembly of the example portable ice barrel of FIG. 9 with a lid in the closed position.
Figure 12E:
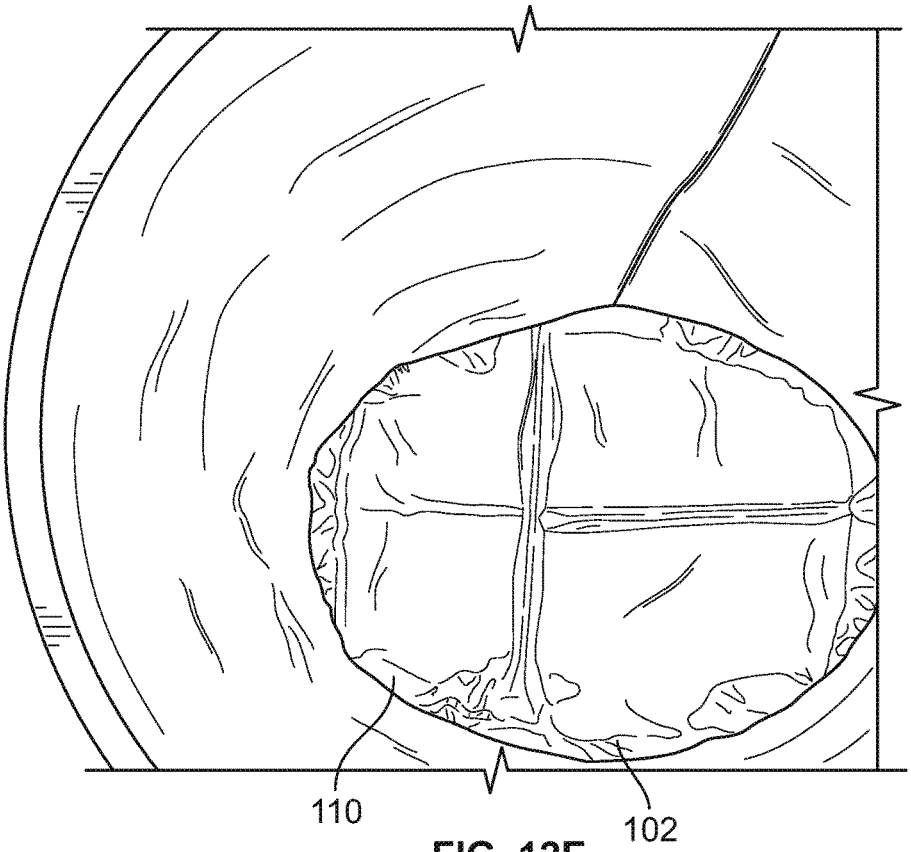
FIG. 12E depicts a perspective top view of the interior of the example portable ice barrel of FIG. 9.
Figure 12F:
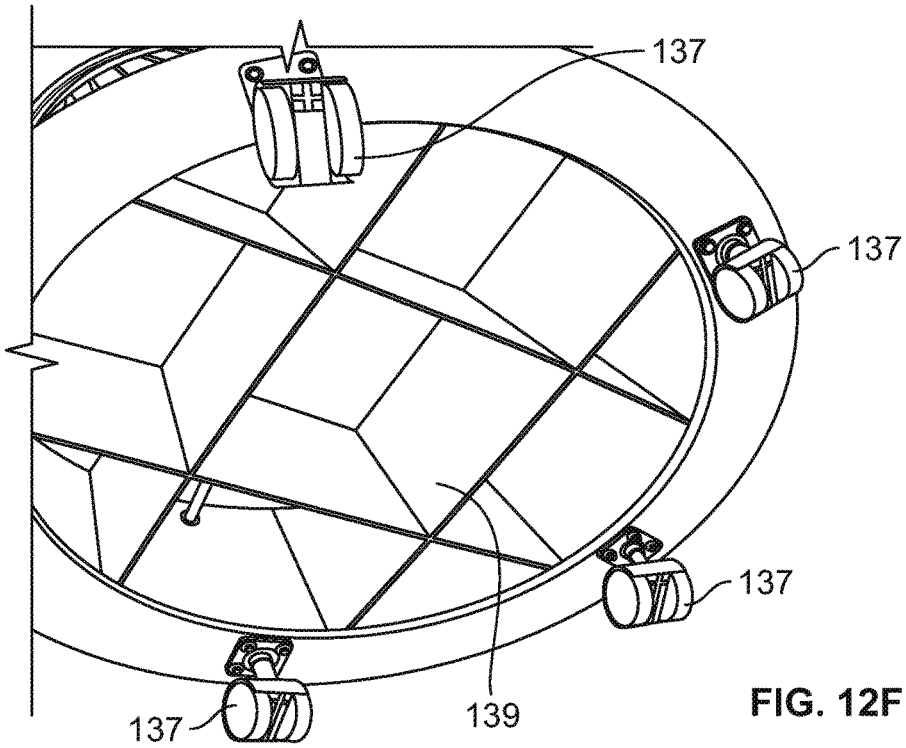
FIG. 12F depicts a perspective bottom view of the example portable ice barrel of FIG. 9.

FIGS. 12A-12D depict perspective side and top views of the portable ice barrel 101 before attachment of the exterior barrier wall 103 onto the portable ice barrel 101. As shown in FIG. 11-12D, the outermost surfaces of the barrel sections 104 can be formed with a series of fins 142. When the portable ice barrel 101 is assembled, the fins 142 extend from an outermost wall forming the barrel sections 104 to the exterior barrier wall 103. The fins 142 are configured to trap air between the exterior barrier wall 103 and the liner 102. Air is generally a good thermal insulator, and helps to slow outside or ambient temperatures from melting the ice or warming the contents stored in the interior barrel cavity 110. Alternatively, the fins 142 trap air to help prevent heat from escaping the interior barrel cavity 110 should it be desired to store warm contents. In this way, the barrel sections 104 provide thermal insulation to the liner 102 and the contents stored therein.

Figure 13A:
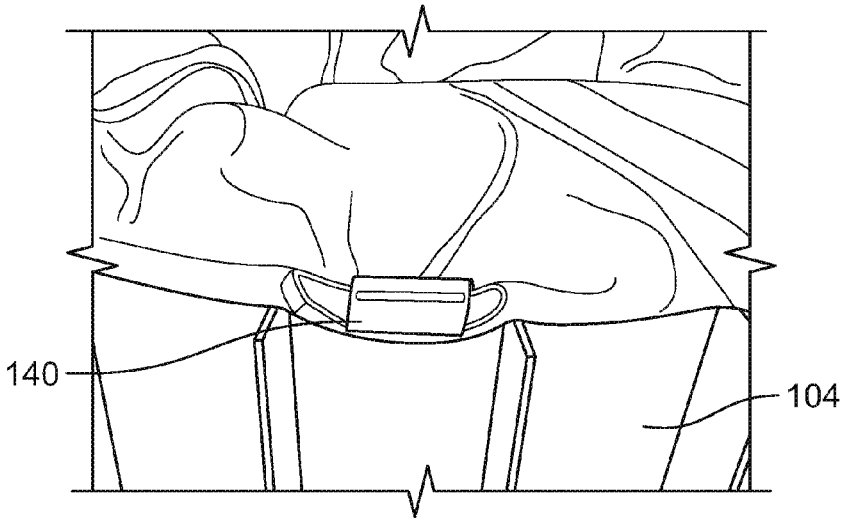
FIG. 13A depicts a side view of a partial assembly of the example portable ice barrel of FIG. 9.
Figure 13B:
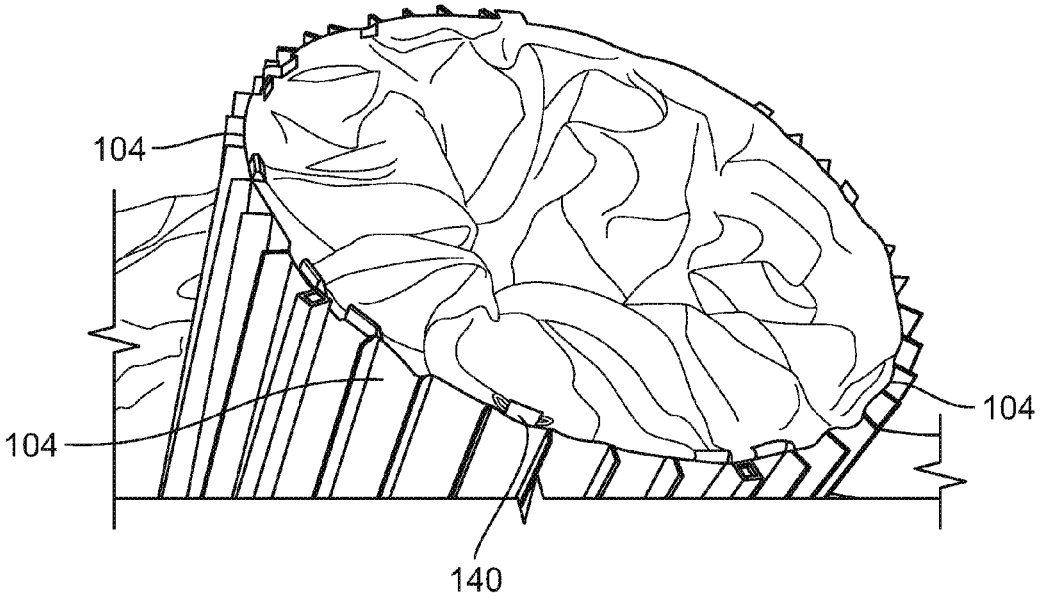
FIG. 13B depicts a perspective view of an example liner that can be used in conjunction with the example portable ice barrel of FIG. 9.
Figure 13C:
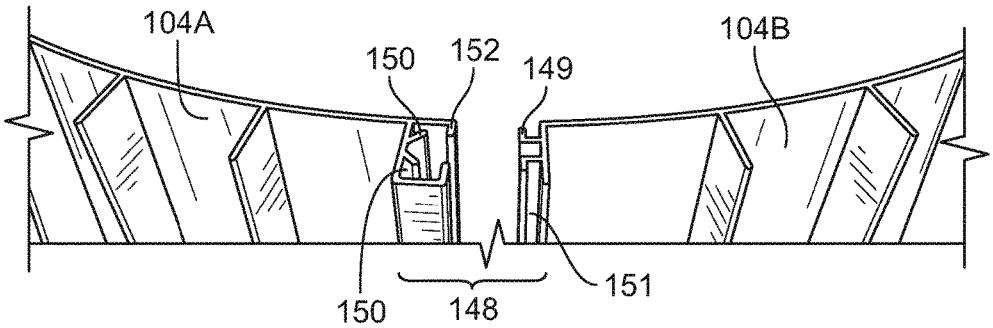
FIGS. 13C-13I depict perspective views of an example connection method that can be used in assembling the example portable ice barrel of FIG. 9.
Figure 13D:
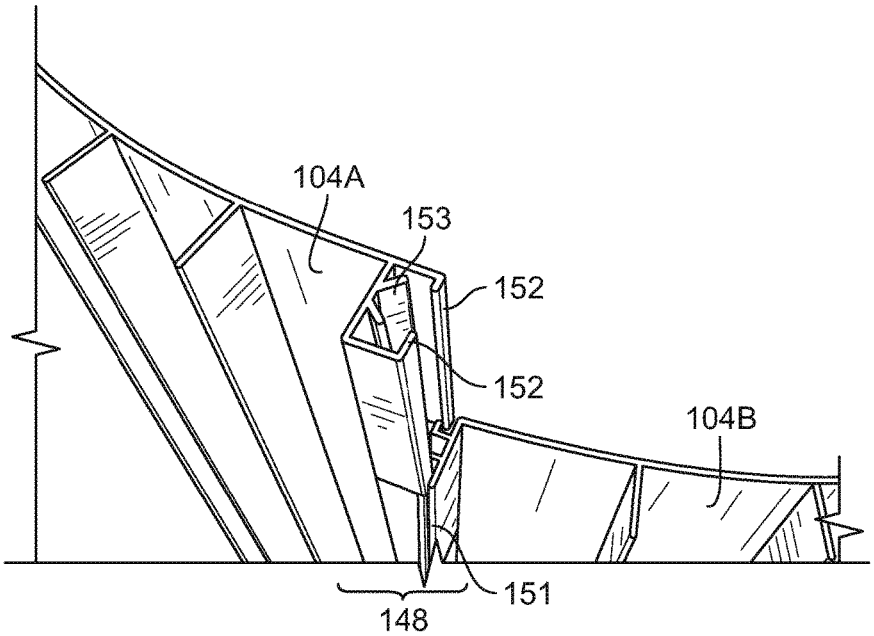

FIGS. 13A-13F show partially formed barrel sections 104A, 104B to illustrate an example connection method for securing the barrel sections 104A, 104B together. As shown in FIGS. 13A-13F, the barrel sections 104A, 104B can be provided with tongue and groove type connections 148. In particular, each side of the barrel sections 104A, 104B can be provided with either a tongue 149 or a groove 150. The tongue 149 can be formed of two L-shaped legs 151 that project outwardly. The L-shaped legs 151 of the tongue 149 can be formed of a thin plastic material such that the legs have a degree of resiliency. Additionally, the groove can be defined by two facing L-shaped legs 152 and a resilient V-shaped projection 153. The legs 151 can be configured to resiliently extend into the groove 150 such that when the legs 151 of the tongue 149 are placed into contact with the groove 150, the L-shaped legs 151 contact the L-shaped legs 152 causing the L-shaped legs 151 to resiliently bias against the L-shaped legs 152. As shown in FIG. 13D to secure the barrel sections 140A, 140B together the tongue 149 is aligned with the groove 150 such that the legs 151 extend into the groove 150. Once the L-shaped legs 151 are placed into contact with the L-shaped legs 152, the barrel sections 140A, 140B are held together securely in both a vertical and horizontal direction. It is contemplated that the barrel sections 140A, 140B can be secured together using any known connection method such as removable fasteners, adhesives, snap-fit, etc.

Figure 13E:
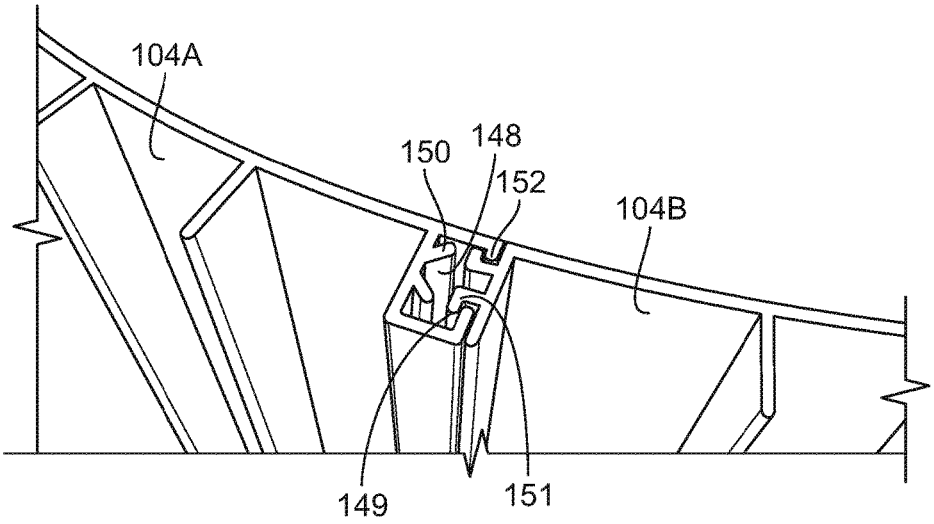
Figure 13F:
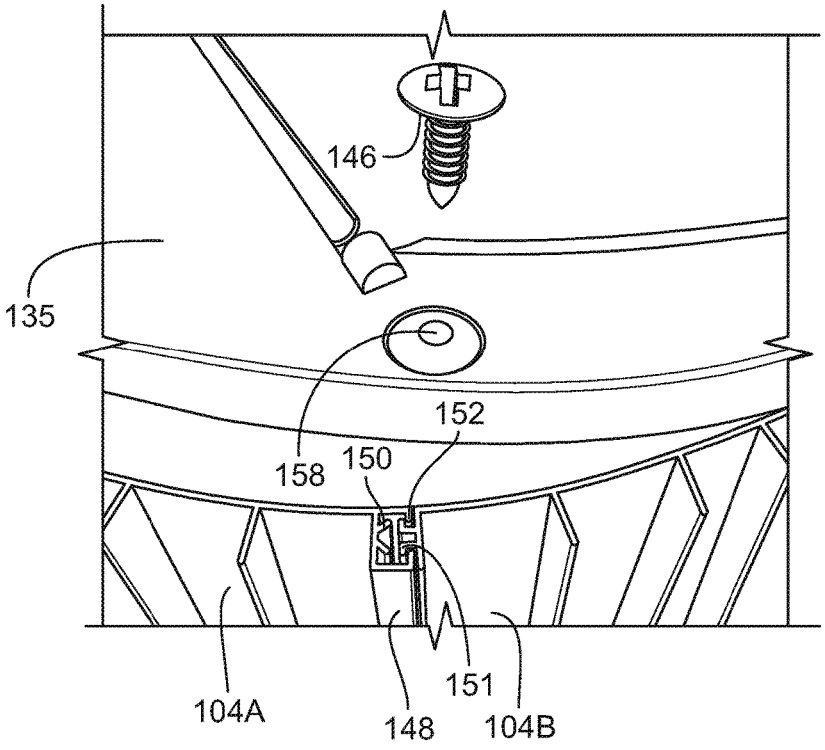

As shown in FIGS. 13F-13I, once the barrel sections 104A, 104B are secured together, the L-shaped legs 151, the L-shaped legs 152, and the V-shaped projection 153 also define a recess for receiving a push-in clip 146 located on a top wall section to secure the top wall 135 to the top of the barrel sections 104A, 104B. As depicted in FIG. 13F, the push-in clip 146 can be a Christmas tree-type clip. As shown in FIG. 13F, the clips 146 are installed through a hole 158 in the top wall 135. The clips 146 can be provided with resilient ribs, which extend along the length of the shaft of the clips 146. When the push-in clips 146 are engaged with the recess formed by the L-shaped legs 151, the L-shaped legs 152, and the V-shaped channel, the ribs located on the shaft of the clips 146 maintain the top wall 135 on the barrel sections 104A, 104B. In this way, the clip 146 can be designed as a one way, press fit application such that once installed, the clips 146 are extremely difficult to remove to secure the top wall 135 to the insulation layer 160. The clips 146 can be configured to require no turning of a screw or fastener, which reduces the amount of labor to assemble the portable ice barrel.

Figure 14A:
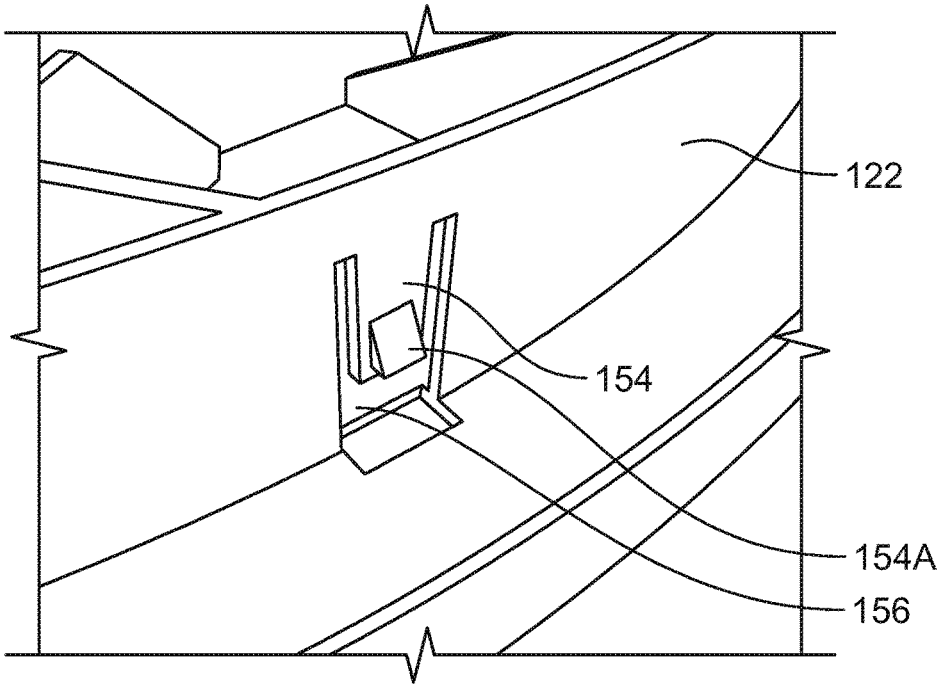
FIGS. 14A-14E depict perspective views of another example connection method that can be used in assembling the example portable ice barrel of FIG. 9.
Figure 14B:
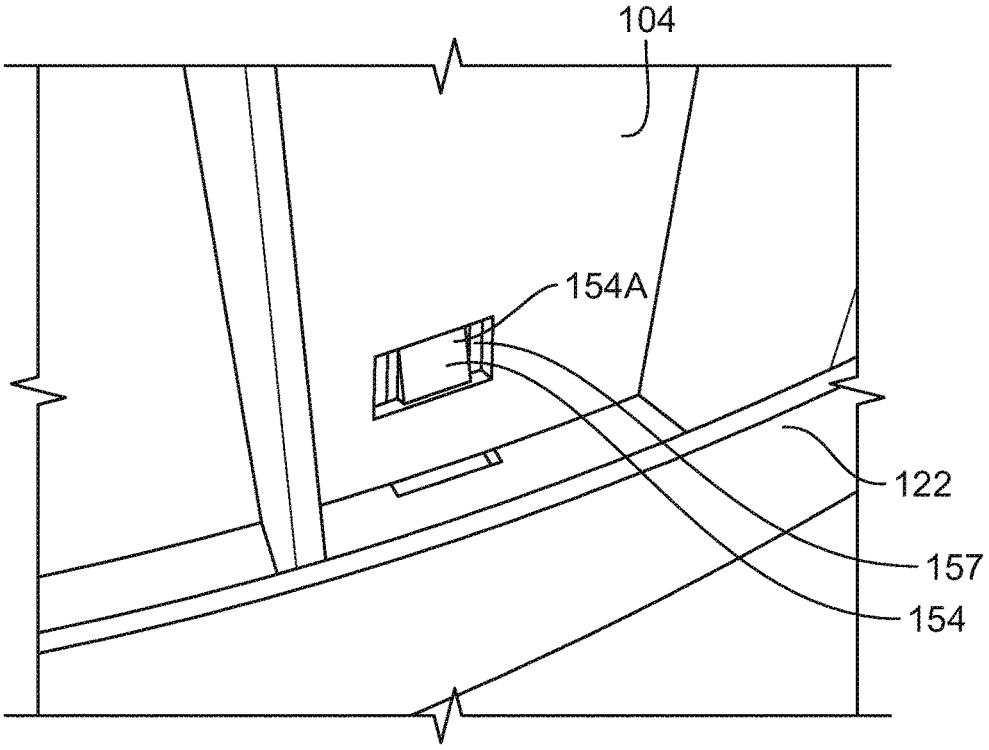

FIGS. 14A-14E illustrate partially formed bottom sections of the barrel sections 104 to illustrate a method of connecting the bottom rim 122 to the barrel sections 104. As shown in FIGS. 14A-14E, the bottom rim 122 can be provided with a resilient locking tab 154 for securing the bottom rim 122 to the barrel sections 104 without the use of tools. In particular, the bottom rim 122 can be provided with an opening 156, which provides a cutout for the locking tab 154 to flex. The barrel sections 104 can be provided with a corresponding opening 157 for receiving the locking tab 154. Once the bottom rim 122 is placed into contact with the barrel sections 104, the locking tab 154 flexes within the opening 156 and into the corresponding opening 157 to secure the bottom rim 122 to the barrel sections 104. As shown in FIG. 14A, the locking tab 154 can be provided with a ramp 154A, which permits the locking tab to move outwardly when the bottom rim 122 is placed into contact with the barrel sections 144A-144F. Once the locking tab 154 is aligned with the opening 157 the resiliency of the tab moves the ramp 154A inwardly into the opening 157 to secure the bottom rim 122 to the barrel sections 104.

The liner 102 can be formed of a similar liner material as the example shown in FIGS. 1-8. Additionally, as shown in FIGS. 11, 15, and 13A, a series of clips 140 can be used to support the liner 102 inside the portable ice barrel 101. In particular, the liner 102 can be held in place onto the insulation layer 160 by a series of clips 140. The clips 140 can be formed U-shaped such that the clips 140 can extend over the rim of the insulation layer 160 and the liner 102 to securely hold the liner 102 into place in the portable ice barrel 101.

Figure 13G:
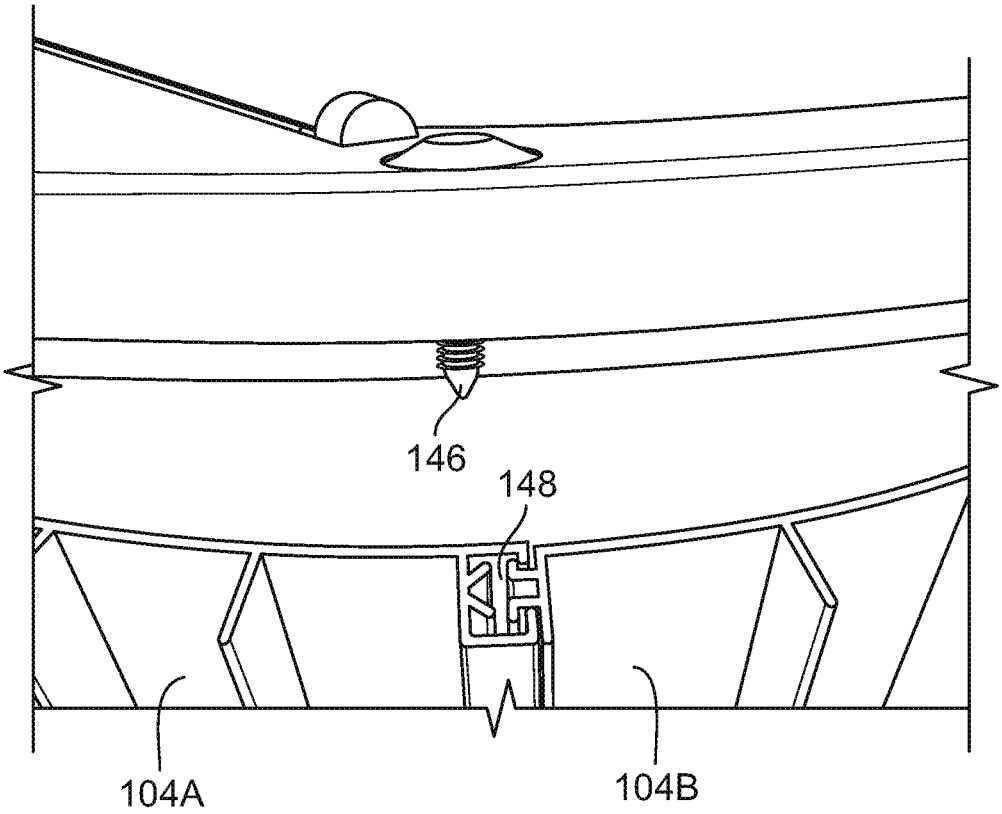
Figure 13H:
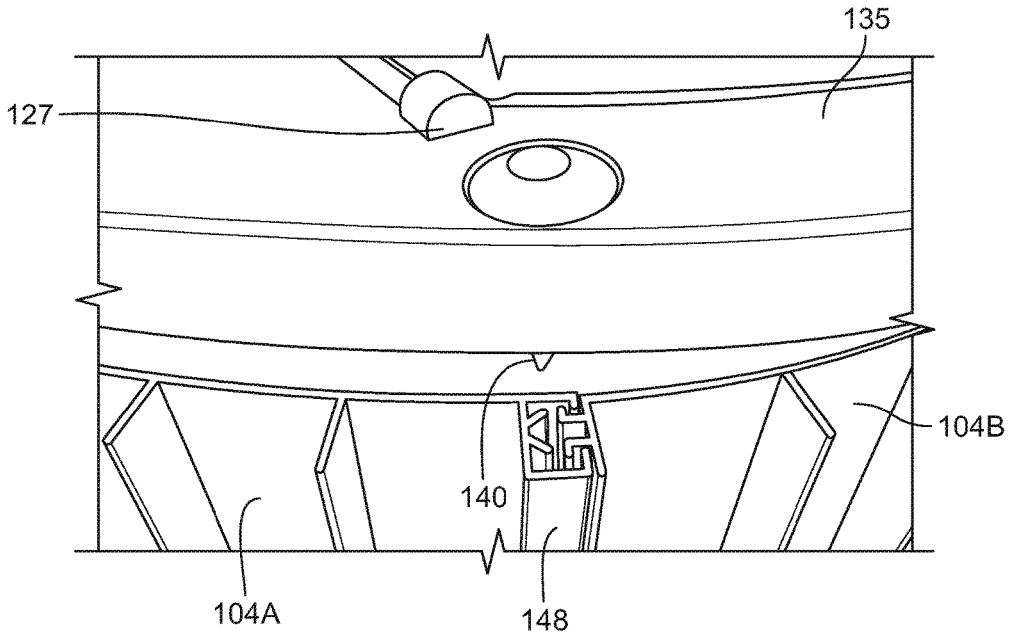
Figure 13I:
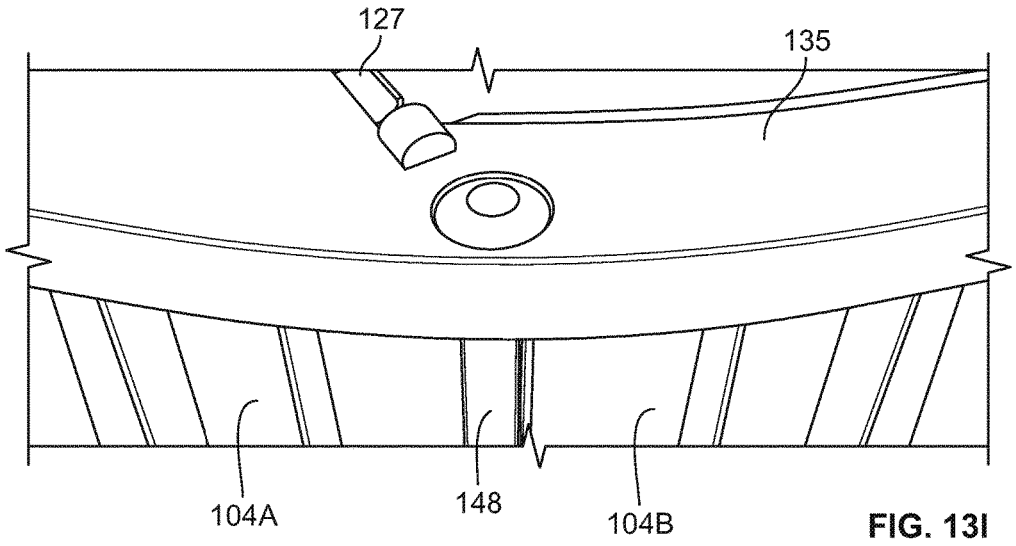

In one example, the top wall 135 can be formed of sections. As shown in FIGS. 13G and 13E, the sections can make up the hinge 127 for receiving the lid 124. Although not shown, the sections can also form the partial rim 119, and can be secured to the sections forming the hinge 127 using any known method. As discussed above, the top wall 135 can be secured to the barrel sections 104 using a push-in clip 146.

Figure 14C:
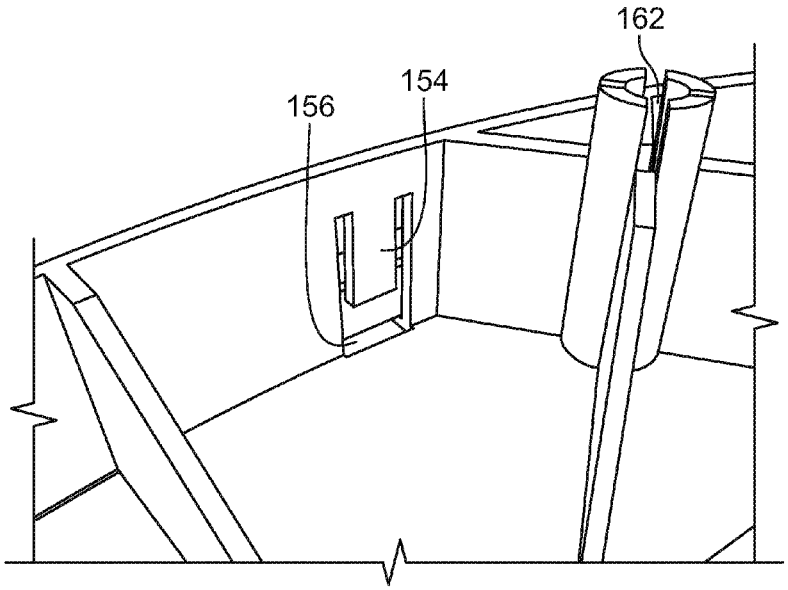
Figure 14D:
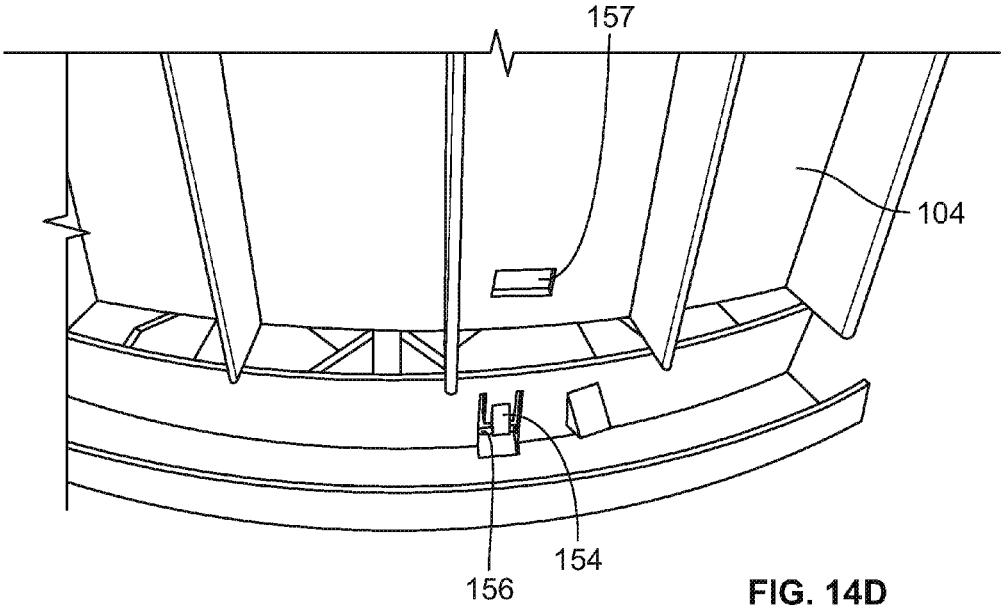
Figure 14E:
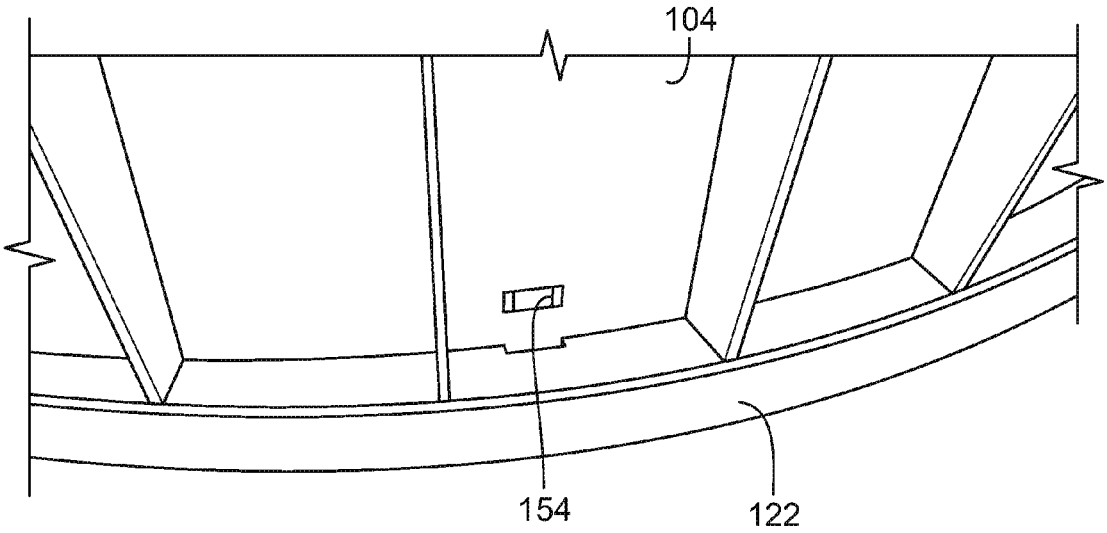

The base assembly 136 can be formed of a support disc 138, a series of supports 139A-139D to form a grid 139, the bottom rim 122, and wheels 137. As shown in FIG. 14C, the bottom rim 122 can be formed with a wheel mount or projection 162 for receiving the wheels 137. The supports 139A-D and grid 139 form an inexpensive, transportable, and robust foundation structure. As shown in FIG. 11 each support 139A-139D can be provided with a series of slits 143 for receiving a respective slit 143 on a corresponding support grid 139. Therefore, the grid 139 can be assembled quickly by aligning the slits 143 on the supports 139A-D. Although in this example four supports are provided, the grid 139 can be provided with two or more supports depending on the size and desired strength of the base assembly. The supports 139A-139D can be formed of any known and suitable material and in one example can be formed of a plastic material, cardboard, or other like material. In another embodiment, the base assembly can be formed by a single collapsible bottom rim that incorporates a living hinge. The casters are secured to a collapsible barrel bottom rim by a plurality of support tubes.

The drain pipe 107 can be formed similar to drain pipe 7 and extends from an interior of the portable ice barrel 101 to the exterior to provide for an outlet for ice water. In one example, the drain pipe 107 can be built into the liner 102. Additionally, one of the barrel sections 104 can be provided with a die cut hole for receiving the drain pipe 107 there through.

To assemble the portable ice barrel, the barrel sections 104A, 104B can be connected to one another using the tongue and groove connection as described above. The base 136 can then be assembled by forming the supports 139A-139D into a grid 139. The disc 138 and the support grid 139 can then be placed inside the insulation layer 160 formed by the barrel sections 104A, 104B. The disc 138 and the support grid 139 can then be held in the barrel sections 104A, 104B by securing the base rim 122 to the barrel sections 104A, 104B. The wheels 137 can then be placed on the base rim 122, and can be held into place on the base rim 122 via a snap fit. The base rim 122 can be secured to the barrel sections 104A, 104B by aligning the tabs 154 with the holes 157. As shown in FIG. 13A the liner 102 can be pulled or stretched over the insulation layer and held into place by the clips 140. The top wall 135 and partial top rim 119 can then be assembled, and the lid 124 can be secured to the top wall 135. Once the top wall 135 is formed, the top wall 135 can be secured to the top of the barrel sections 104A, 104B by the clips 146. The top wall 135 and top rim 119 also secure the liner 102 by a press fit between the top rim 119 and the barrel sections 104. Finally the exterior barrel wall 103 can be printed and then placed around and secured to the barrel sections 104A, 104B.

FIGS. 15A-15F depict another example portable ice barrel 201, where like reference numerals refer to the same or similar elements in all of the various views but include 200 series reference numerals. The example shown in FIGS. 15A-15F is similar to the example shown in FIGS. 9-14E, however this example implements an optional exterior liner 204 instead of barrel sections. The example shown in FIGS. 15A-15F also has a different base assembly 236, but the base disclosed in relation to the example discussed in relation to FIGS. 9-14E can optionally be used in conjunction with this example.

Figure 15A:
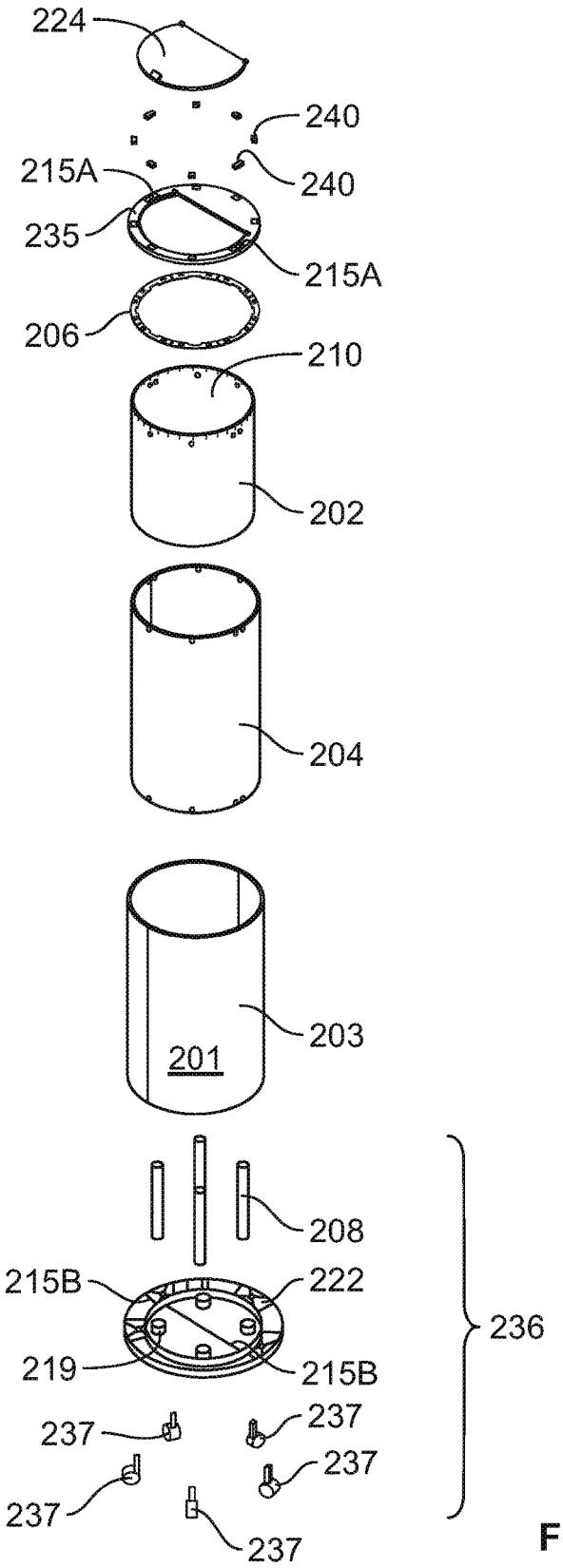

FIG. 15A shows an exploded view of the example portable ice barrel 201. The example portable ice barrel 201 can include lid 224, which can incorporate living hinges 215A to allow the lid to be folded for compact shipment or storage. Similar to the example shown above in FIGS. 9-14E, an insulation layer may be formed by trapping air between the interior liner 202 and the exterior barrel wall 203. Like in the example shown in FIGS. 1-8 and 9-14, the liner 202 forms an interior barrel cavity 210 for receiving contents, such as ice and any desired products. The interior liner 202 can be configured to be collapsible such that it can be packed efficiently during shipment. Fasteners, hole plugs, or clips 240 can be included to secure the top rim 235 to the interior liner 202 and an optional collapsible heat stake plate 206. The top rim 235 may incorporate living hinges 215A to provide for collapsibility, and fits over the optional heat stake plate 206, interior bladder or liner 202, optional exterior liner 204, and exterior wall 203. The optional exterior liner 204 can be formed of a single sheet of material that can be rolled into a smaller shape for packing efficiently. The exterior wall 203 can be formed of a 0.09 inch thick styrene sheet that can be formed into a cylinder. The styrene sheet can formed be with a channel extending along one of the edges such that the other edge can be placed into the channel to form the exterior wall into a cylinder. The exterior wall 203 can also be rolled into a smaller shape for efficient packaging. A graphic label can be included on the exterior wall 203 of the portable barrel 201.

In this example, a base 236 can be formed of a bottom rim 222, casters 237, and support tubes 208. The bottom rim 222 can include a living hinge 215B that allows the bottom rim 222 to be folded into a collapsed position. The casters 237 are configured to attach to the bottom rim 222 via an interference or snap fit connection to allow for an easy assembly. The support tubes 208 are configured to fit onto a series of projections 219 located on the bottom rim 222. However, it is contemplated that the base discussed above in relation to the example in FIGS. 9-14E can be used in conjunction with the example shown in FIGS. 15A-15F and vice versa.

Figure 2:
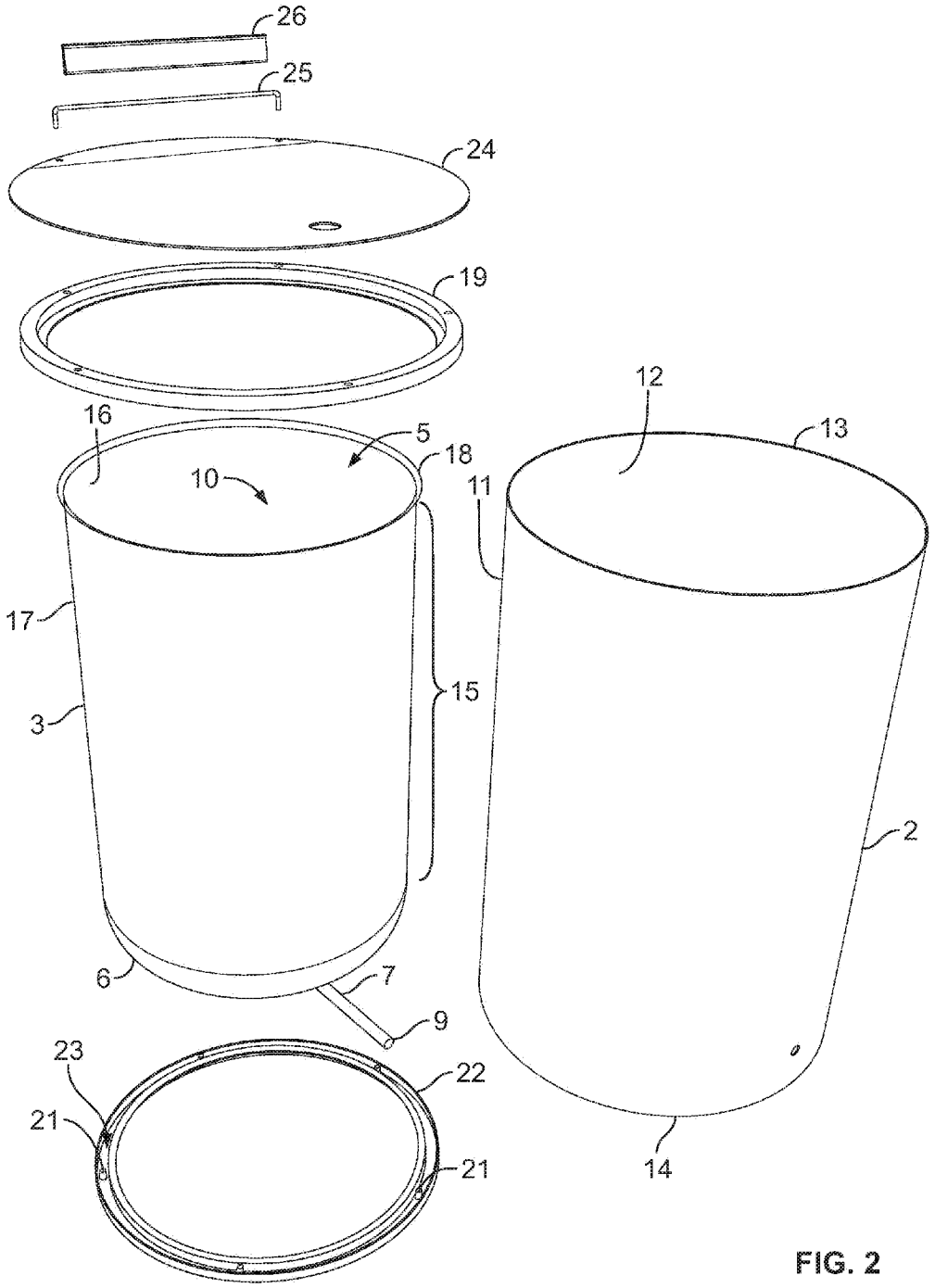
FIG. 2 depicts a top, left perspective exploded view of aspects of an example portable ice barrel.
Figure 3A:
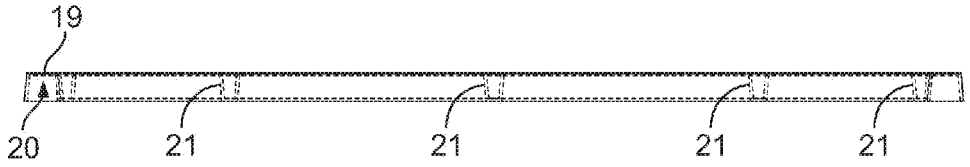
FIG. 3A depicts a side view of aspects of an example top rim of a portable ice barrel.
Figure 3B:
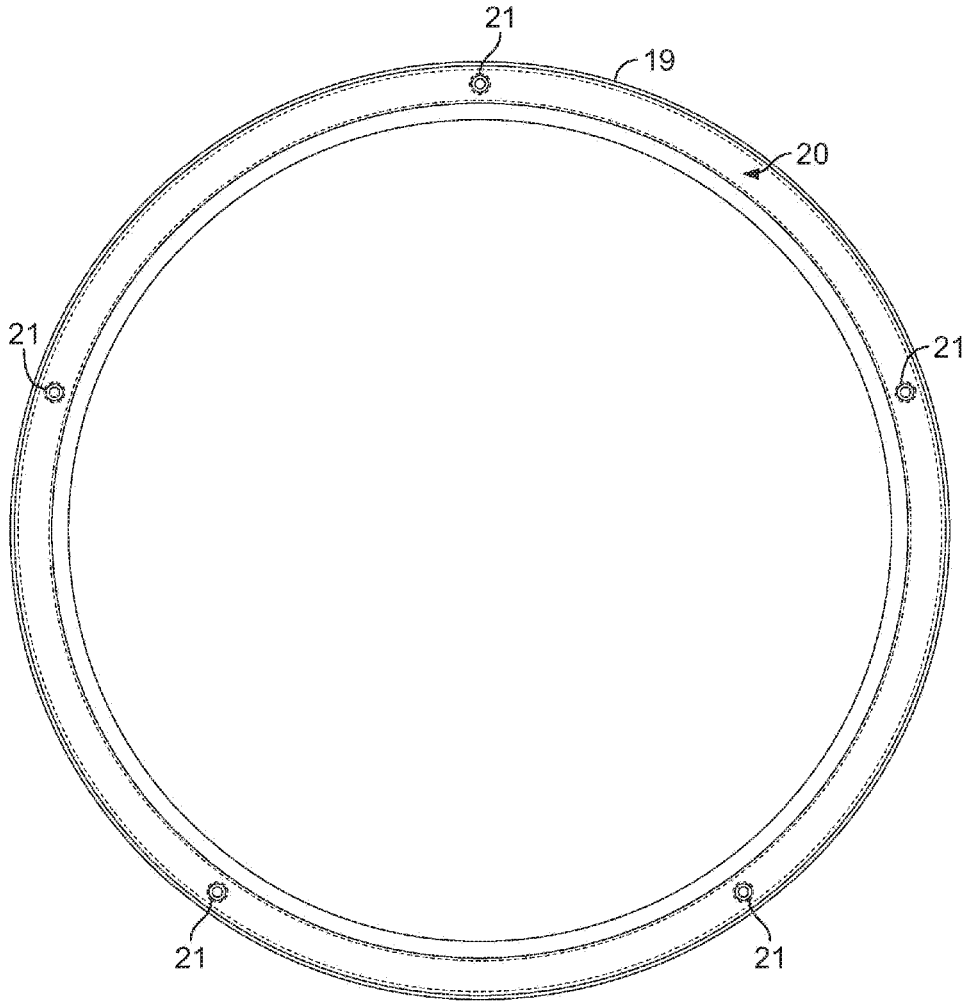
FIG. 3B depicts a top view of aspects of an example top rim of a portable ice barrel.
Figure 3C:
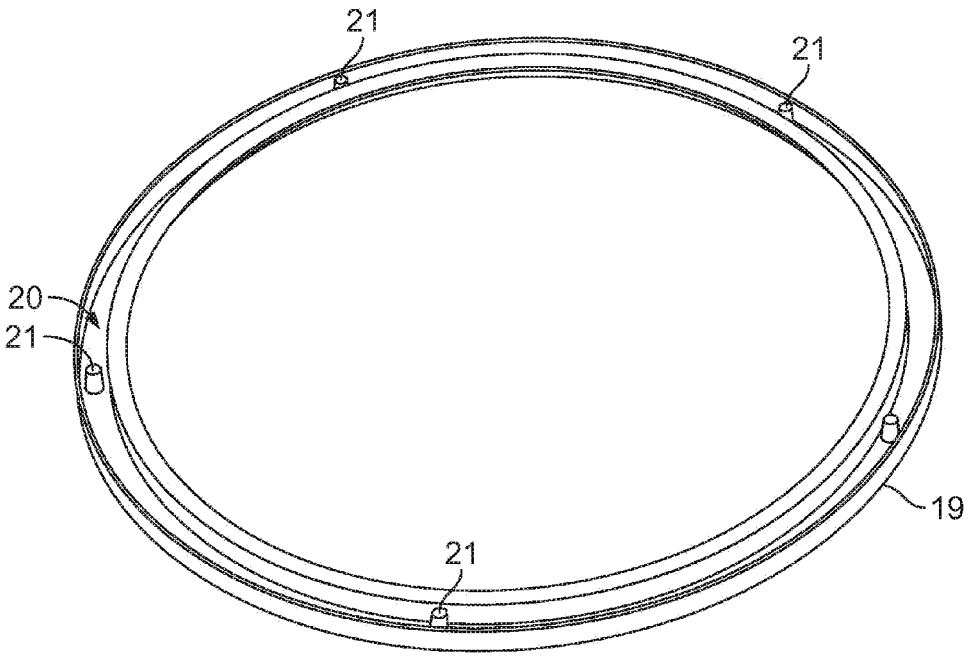
FIG. 3C depicts a bottom, right perspective view of aspects of an example top rim component of a portable ice barrel.
Figure 4A:
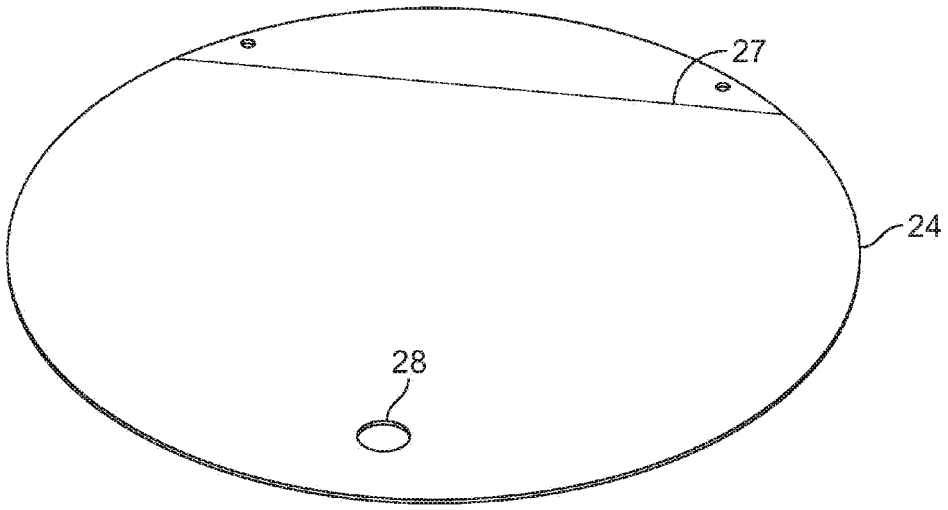
FIG. 4A depicts a top, right perspective view of aspects of an example lid of a portable ice barrel.
Figure 4B:
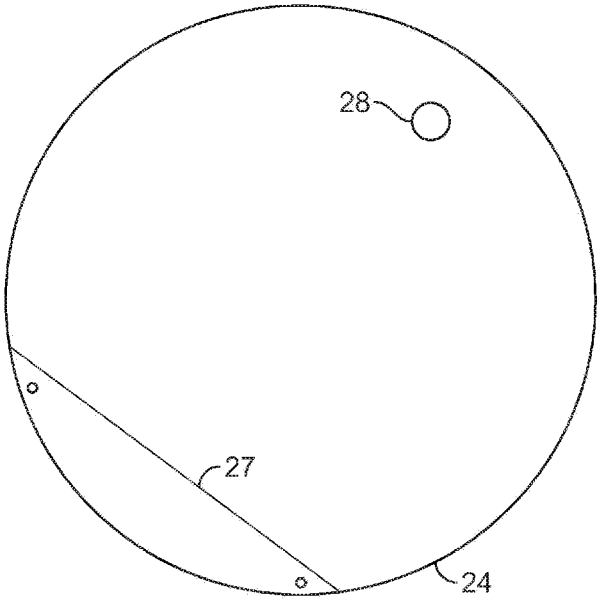
FIG. 4B depicts a top view of aspects of an example lid of a portable ice barrel.
Figure 5A:
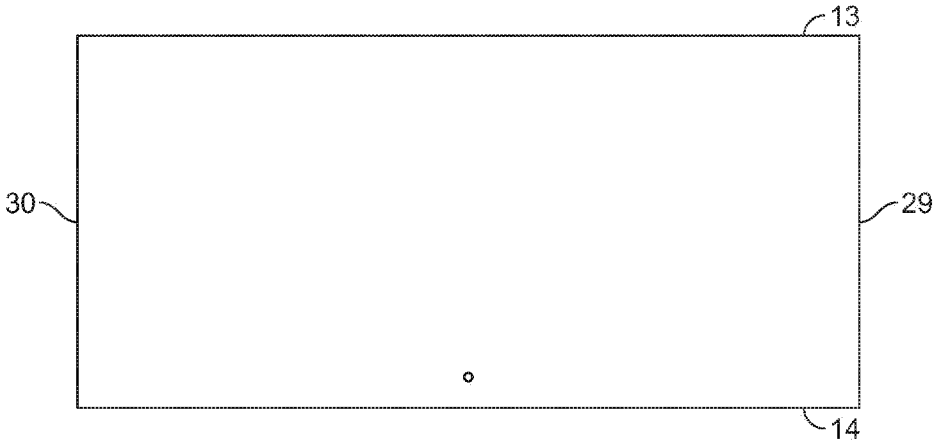
FIG. 5A depicts a front view of aspects of an example exterior barrel wall of a portable ice barrel.
Figure 5B:
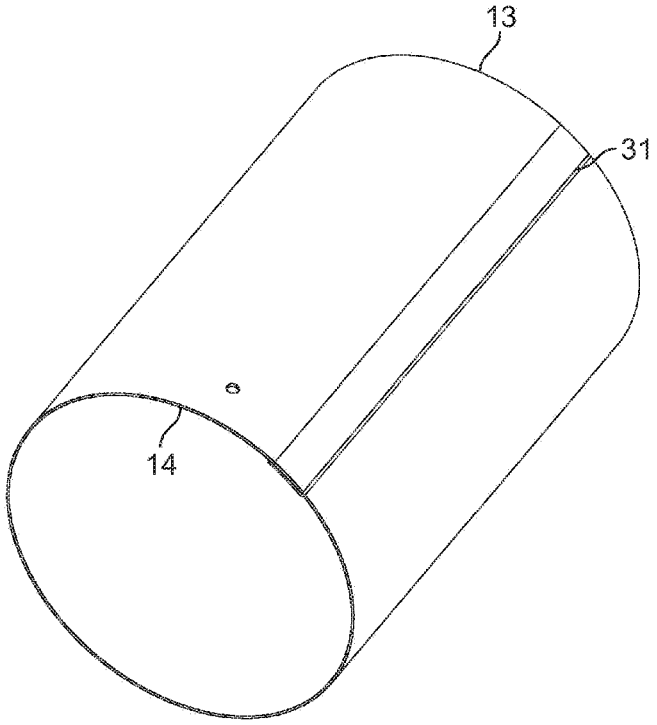
FIG. 5B depicts a bottom, right perspective view of aspects of an example exterior barrel wall of a portable ice barrel.
Figure 6:
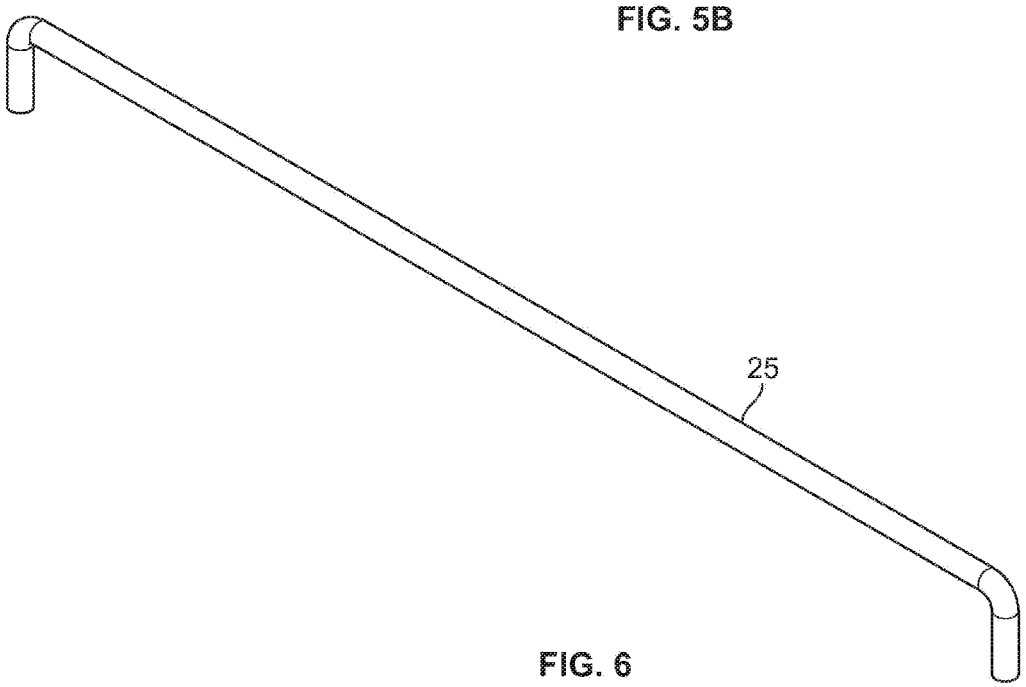
FIG. 6 depicts a top, right perspective view of aspects of an example sign holder bar of a portable ice barrel.
Figure 15C:
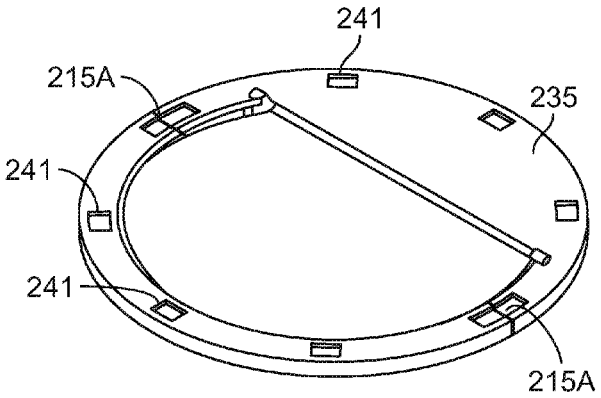
Figure 15C:
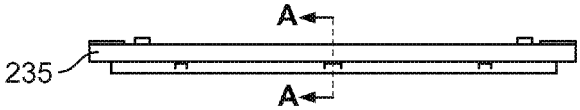
Figure 15C:
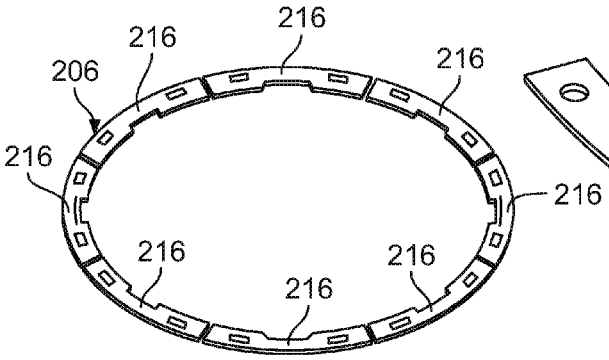
Figure 15D:
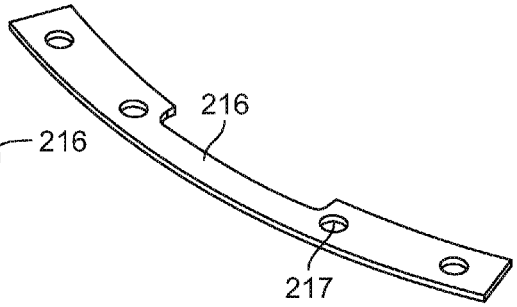
Figure 15E:
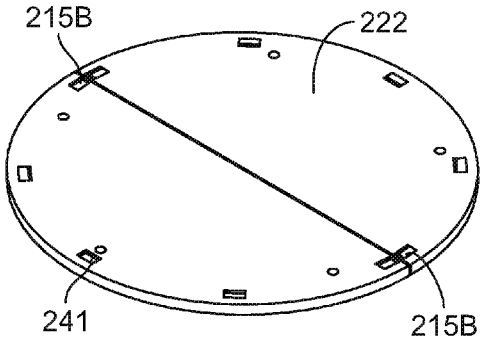
Figure 15F:
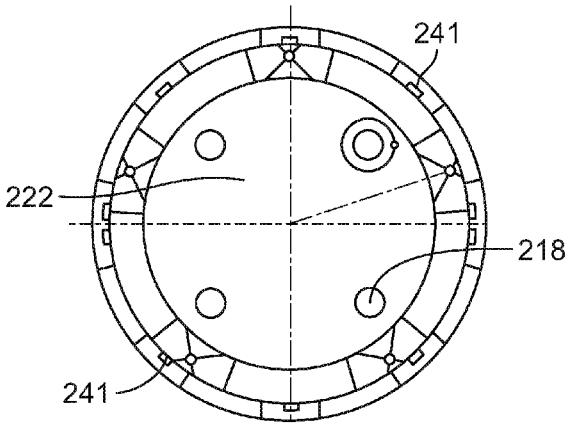

FIG. 15B1 depicts a top view of the collapsible top rim 235, and FIG. 15B2 depicts a side view of the collapsible top rim 235. The top rim 235 can include a living hinge 215A and multiple slots or holes 241. The slots or holes 241 facilitate securing the top rim 235 to the heat stake plate 206, the top of the inner liner 202, the top of the outer liner 204, and the exterior wall 203. FIG. 15C depicts a top view perspective of the heat stake plate 206. Heat stake plate 206 is composed of multiple heat stake plate sections 216 as depicted in FIG. 15D. Heat stake plate sections 216 include slots or holes 217 to accommodate various types of fasteners. The tops and bottoms of inner liner 202, outer liner 204, and exterior wall 203 all include various slots or holes 241 to facilitate the securing of the structures to each other by various types of fasteners. In another example of the portable ice barrel 201, bottom rim 222 and bottom rim 122 discussed above may include a bottom rim channel defined in the bottom of the rim that attaches by tongue and groove to the bottom edge of the exterior wall 203 which can include a tongue and groove type fitting that secures to the bottom rim 122 or optional bottom rim 222. Bottom rim 122 and bottom rim 222 may include living hinges 215B to allow the structure to be folded to decrease shipping volume. FIG. 15E depicts a top view of the bottom rim 222. Collapsible bottom rim 222 incorporates a living hinge 215B and slots or holes 241 for receiving a series of suitable fasteners. In one example, the bottom rim 222 is secured via fasteners to the bottom of inner liner 202, outer liner 204, and exterior wall 203 through the various slots or holes 241. FIG. 15F depicts the bottom rim 222. As shown in FIG. 15F, the bottom rim 122 can be provided with support tube projections 218. During assembly of the portable cooler 201, the support tubes 208 can be placed over the support tube projections 218.

Figure 16:
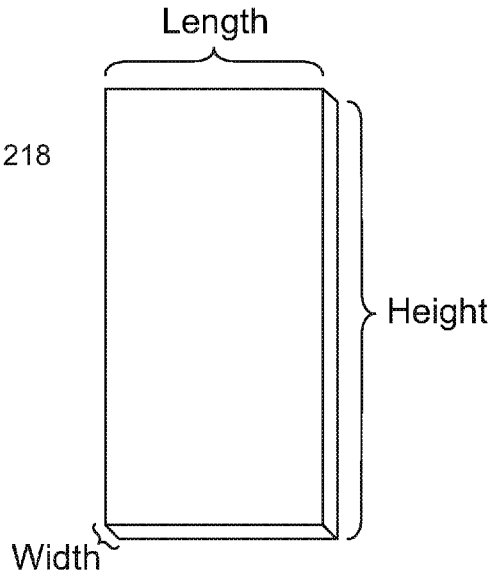
FIG. 16 depicts an example of a shipping container.

FIG. 16 shows an example container that can be used to ship or store the portable cooler examples discussed herein. The portable cooler examples discussed here can be configured to be easily collapsible to fit in a much smaller sized container than traditional ice barrels. The container can define a length, a height, and a width. The width of the container can be less than a diameter of the assembled portable ice barrel. In one example, the ratio of the width of the container to the diameter of the assembled portable ice barrel can range from 1 to 5 to 1 to 3. In another example, the ratio of the width of the container to the diameter of the assembled portable ice barrel can range from 1 to 10 to 1 to 2. In the example container, the height is greater than the length, and the length is greater than the width. The components of the portable ice barrel can be shipped in a container having a predominately flat configuration such that the portable ice barrel can be shipped and assembled at the receiving end. In one example, the portable ice barrel can be packaged in a 34" by 24" by 12" box having volumetric capacity of 9792 cubic inches. In one example, the portable ice barrel can be packaged in a 32" by 24" by 8" box having volumetric capacity of 6144 cubic inches. In one example, the portable ice barrel can be packaged in a 34" by 14" by 8" box having volumetric capacity of 3808 cubic inches.

In one example, the volumetric capacity of the inner liner of the cooler can be 6295 cubic inches for storing the desired contents. In one example, a ratio of the volumetric storage capacity of the inner liner of the portable cooler to the volume of the container can be between 1.5:1 to 4:1.

In another example, the individual components can be shipped separately in individualized containers. The individual components can then be reassembled at the final destination or combined with other units to form complete kits and sold at retail outlets.

Figure 17A:
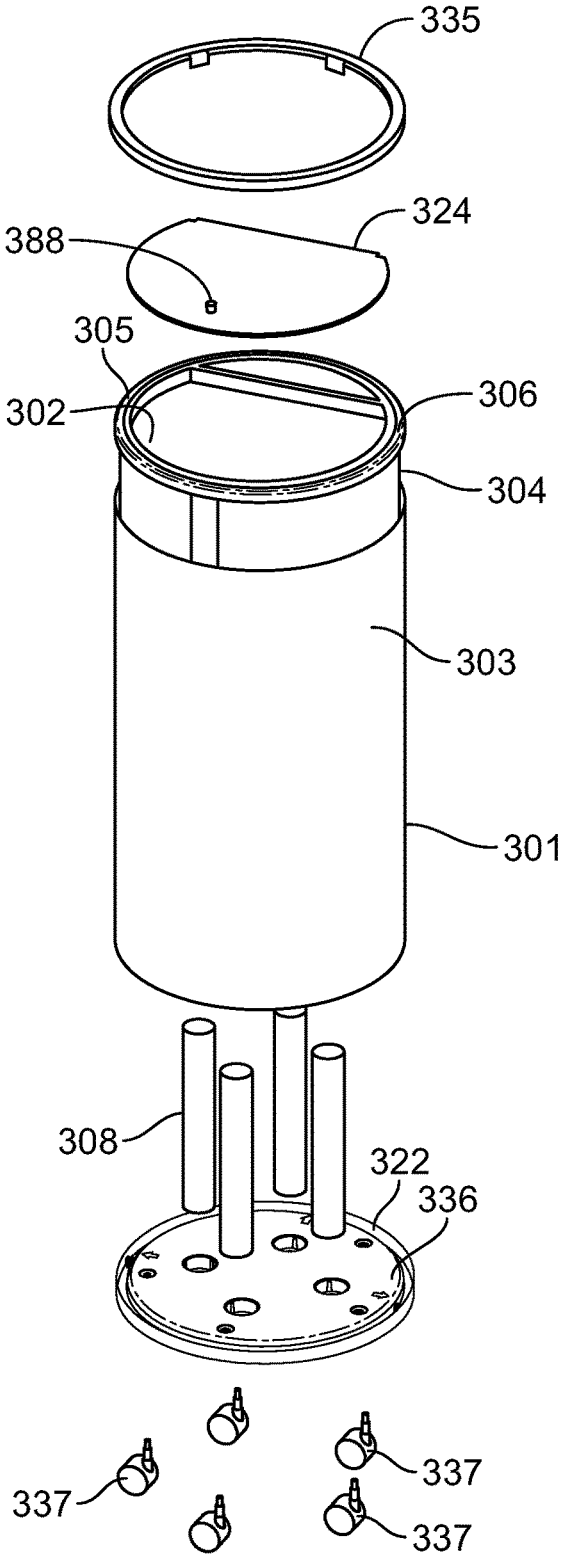
FIGS. 17A-17O depict views of another example insulating device.
Figure 17B:
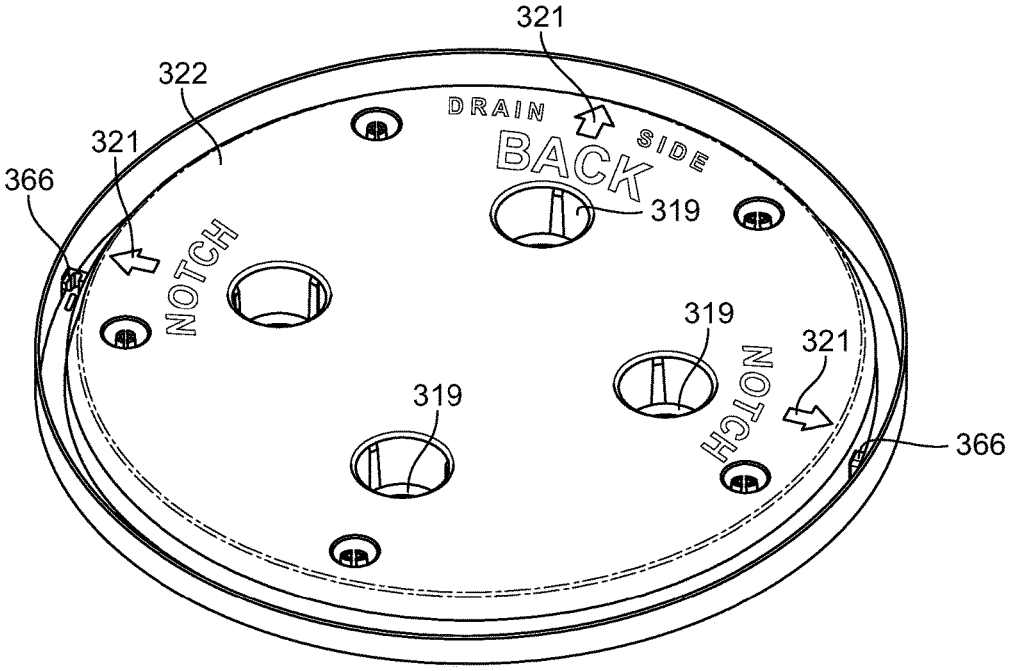
Figure 17C:
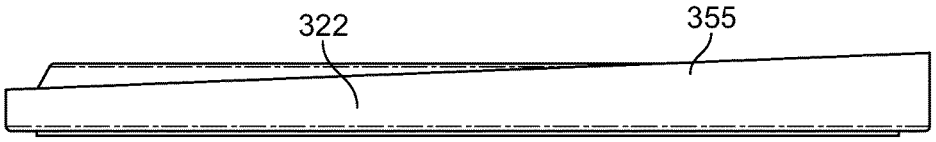
Figure 17D:
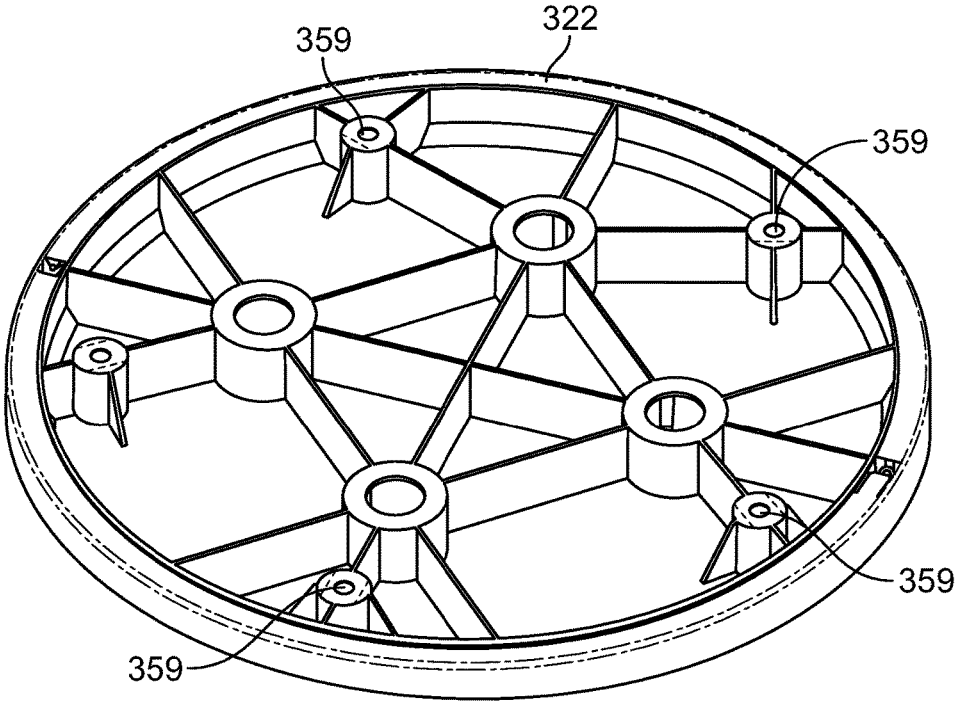
Figure 17E:
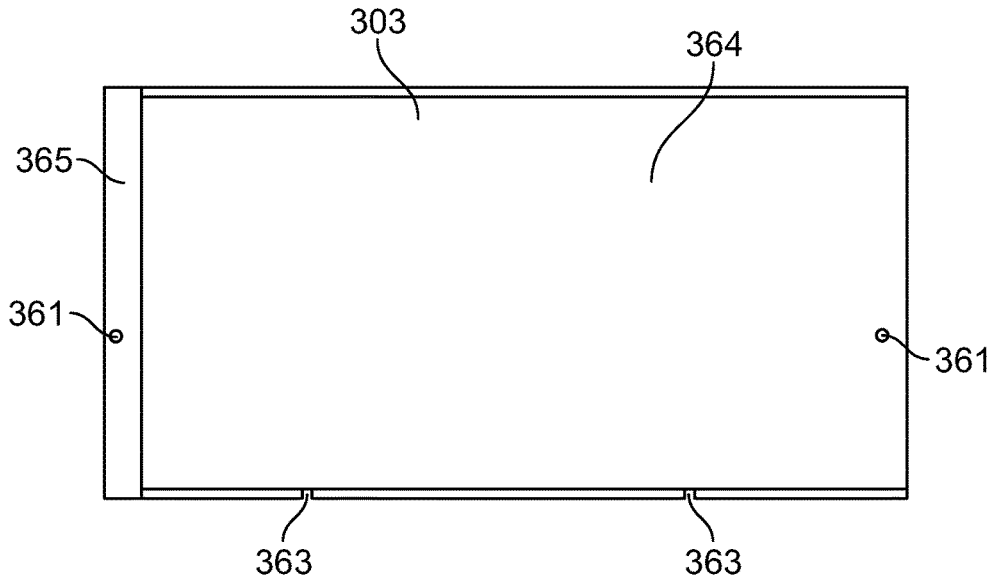
Figure 17G:
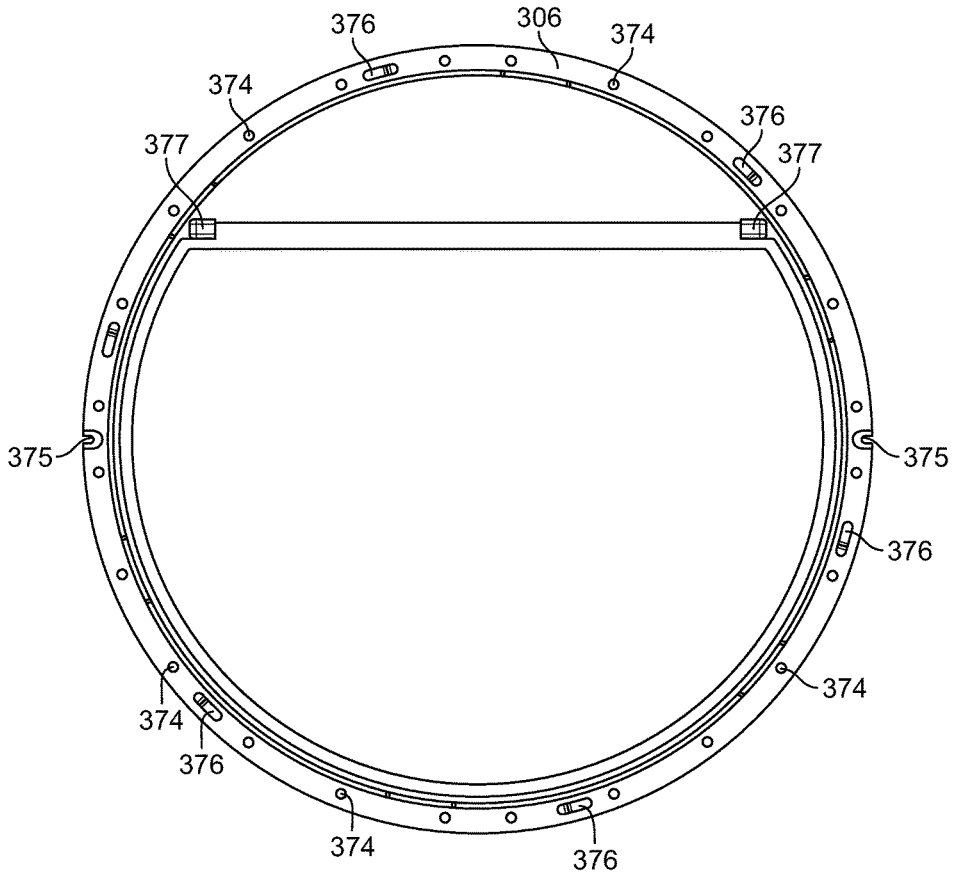
Figure 17H:
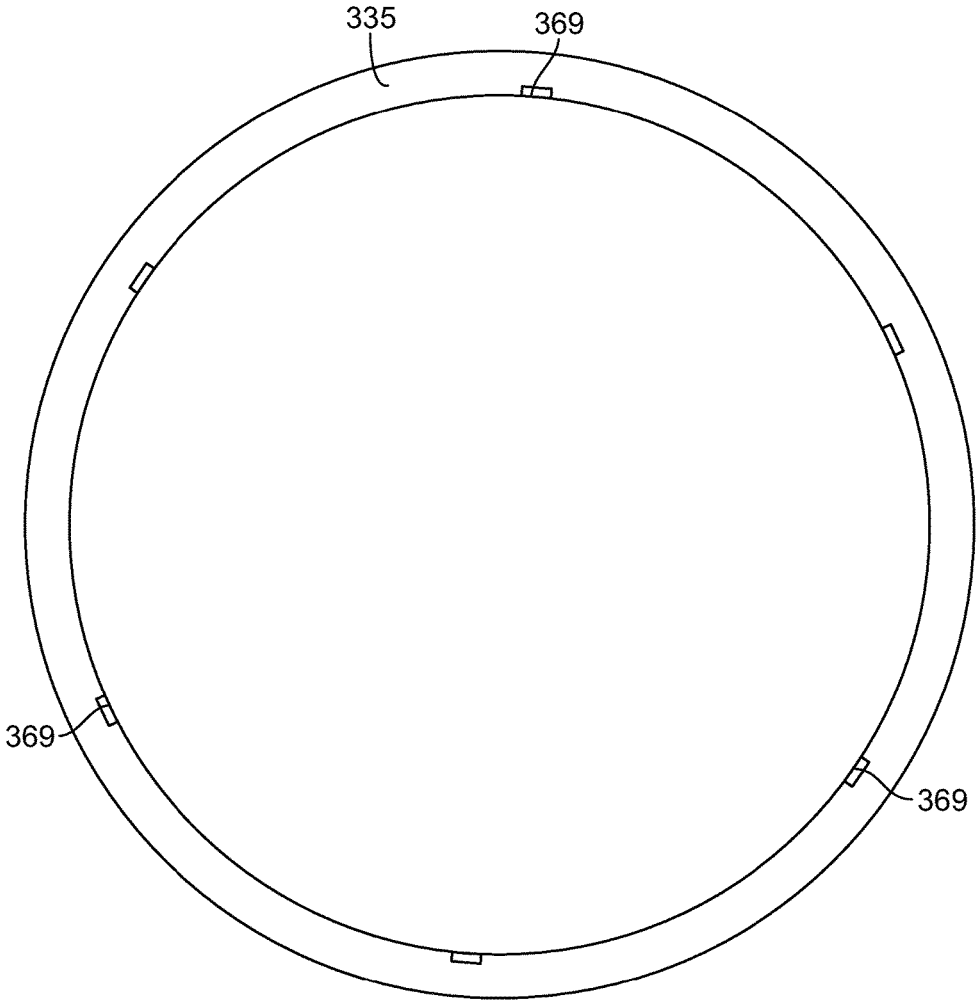
Figure 17I:
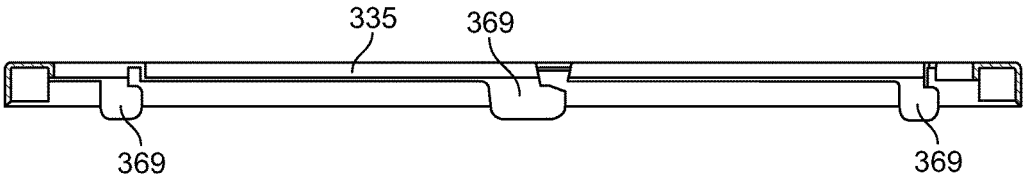
Figure 17J:
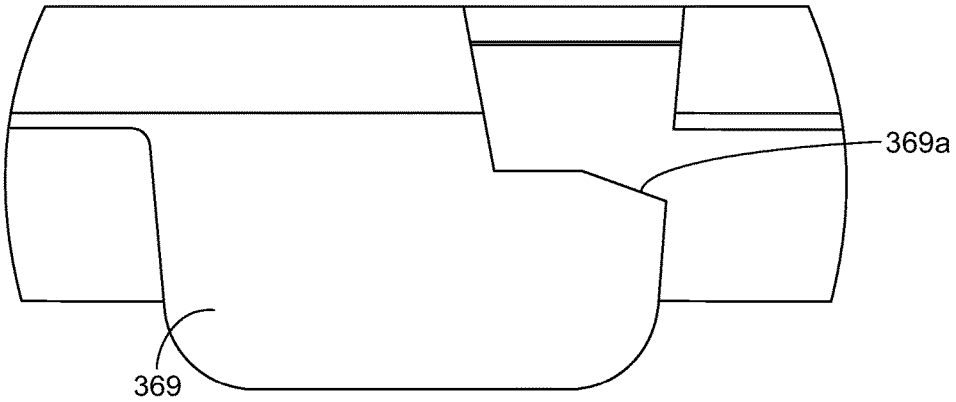
Figure 17K:
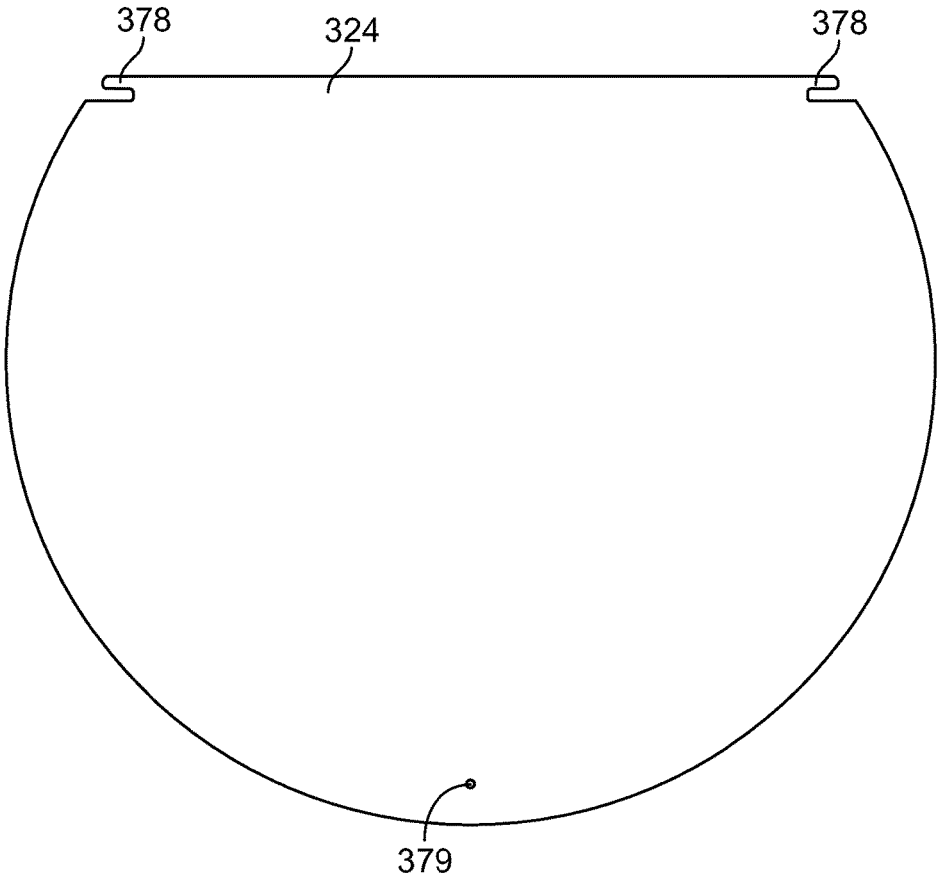
Figure 17L:
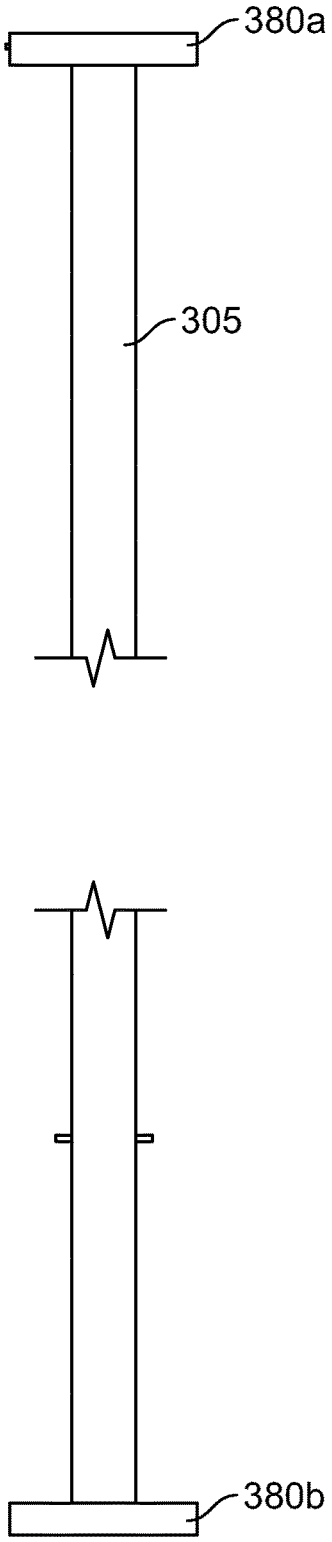
Figure 17M:
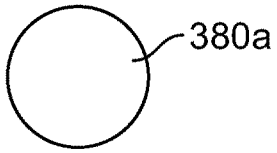
Figure 17N:
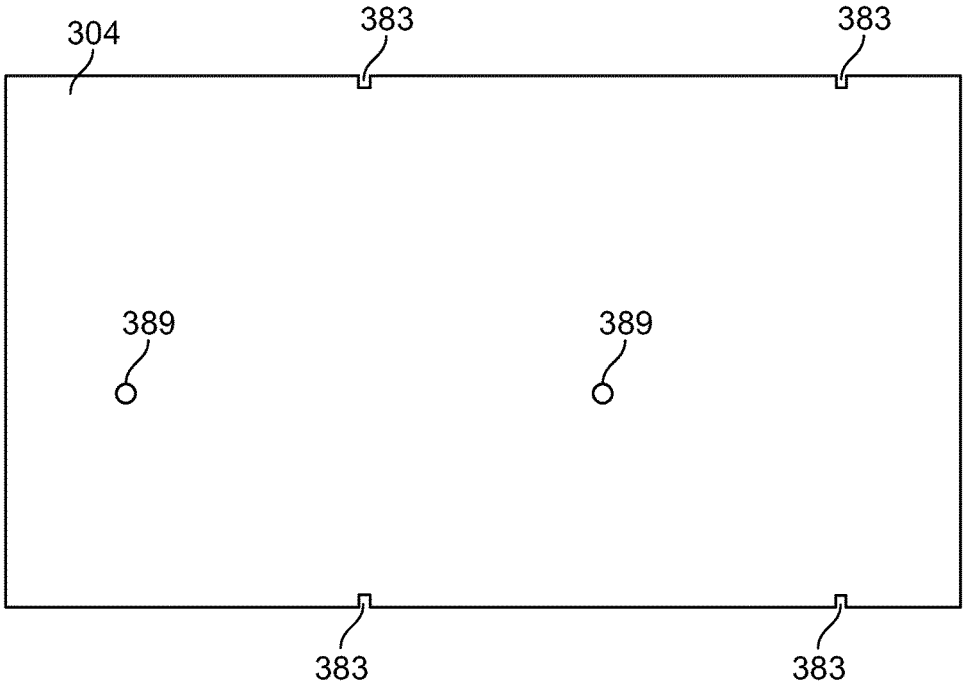
Figure 17O:
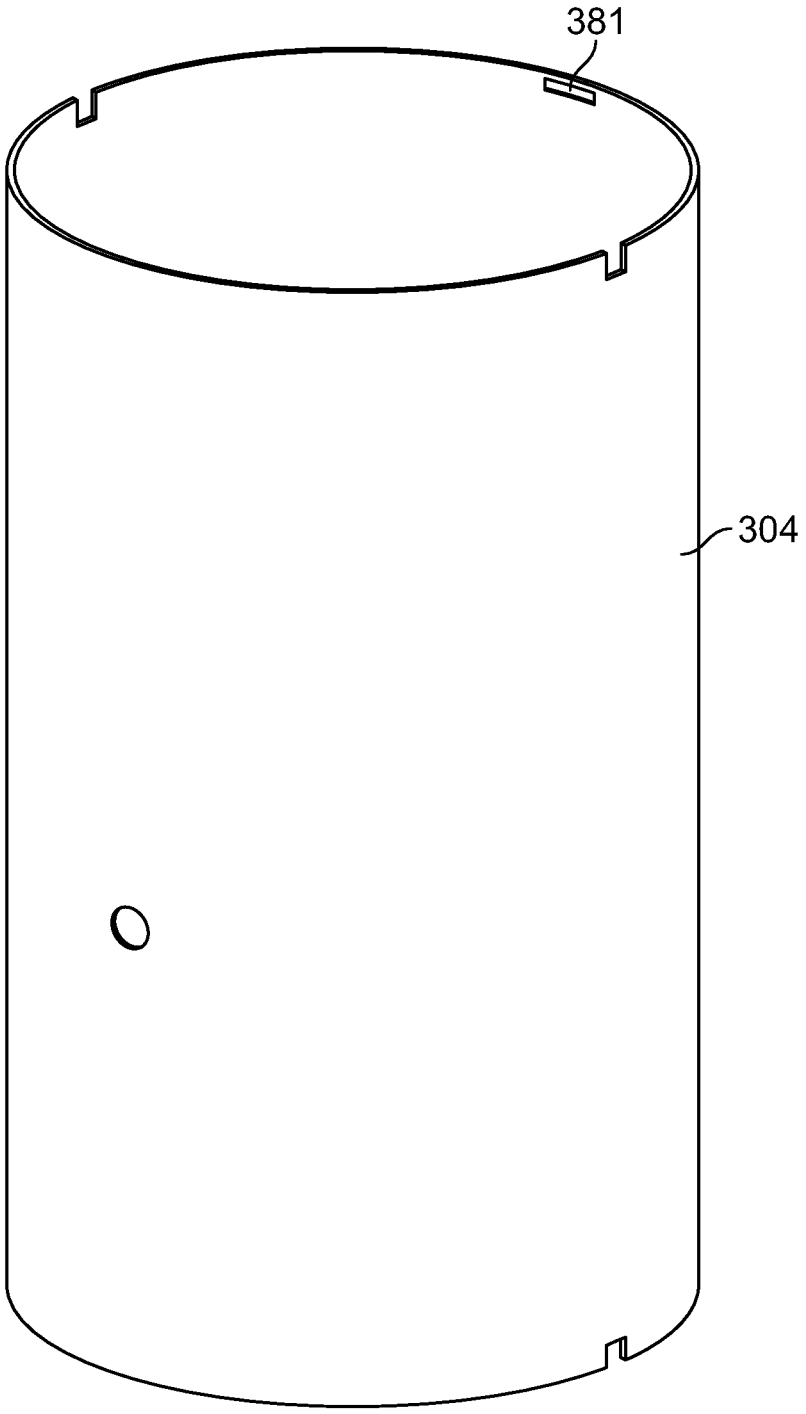

FIGS. 17A-17O depict another example insulating device or container 301, where like reference numerals refer to the same or similar elements in all of the various views but include 300 series reference numerals. The example shown in FIGS. 17A-17F is similar to the example shown in FIGS. 15A-15F; however, this example implements a series of structural wires or rods 305 for structural support of the insulating device 301 in addition to other variations that will be discussed below. The example insulating device 301 can be configured to be a portable and collapsible cooler similar to the above examples. In one example, the insulating device 301 can fit into a 20 in. by 6 in. by 40 in. box for shipment, and the insulating device 301 can have volumes similar to the volumes discussed in relation to the other examples discussed herein. The example insulating device 301 can include a base 336, an exterior wall 303, an interior bladder or liner 302, a liner rim 306 for securing and retaining the liner 302, a lid 324, an exterior liner 304, and a top rim 335.

In this example, the base 336 can be formed of a bottom plate 322, casters 337 having wheels, and supports 308. FIGS. 17B-17D show further detail of the bottom plate 322, where FIG. 17B is a top perspective view, FIG. 17C is a side view, and FIG. 17D is a bottom perspective view. As shown in FIG. 17B, the bottom plate 322 can include a series of openings 319 for receiving supports 308, which can be in the form of tubes or cylinders. The supports 308 are configured to support the bottom of the inner liner 302 when the inner liner 302 is filed, for example, with ice, beverages, or other contents. The supports 308 can thus transfer all of the weight of the inner liner 302 contents to the bottom plate 322 of the insulating device 301. In alternative examples, a single support can be provided or the support can be in the form of a frame that is configured to support the weight of ice and other contents that will be stored in the insulating device 301. The supports may also be telescopically arranged on the base, such that the supports are configured to extend outward during the assembly of the insulating device 301.

The bottom plate 322 may also include one or more indicators 321 to indicate to the user the orientation of the inner liner 302, the exterior liner 304, and the rods 305. For example, as shown in FIG. 17B, arrows can direct the user to the back of the insulating device 301 and notches or inserts 366 located in the bottom plate 322 for assembling the insulating device 301. The series of inserts or notches 366 on the bottom plate 322 are configured to receive the rods 305. In particular, the inserts 366 are configured to receive the ends 380*a*, 380*b* of the wire rods 305. The inserts 366 can also include a ramp surface that is configured to engage the end of the wire rod 305. The ramp surface is provided with an angled surface such that when the end of the wire rod 305 engages the notch, the rod 305 can be pushed along the angled surface and held into place by the ramp surface. The rods 305 may also be held into place on the bottom plate 322 with slots. Other connections between the rods 305 and the bottom plate 322 are also contemplated. For example, one or more of a threaded, ball and socket, or bayonet connections are also contemplated.

Additionally, FIG. 17C shows a side view of the bottom plate 322. Because the exterior wall 303 is placed onto the insulating device last, the exterior liner 304 may interfere with the placement of the exterior wall 303 over the rim 335. Specifically, the exterior liner 304 may prevent the user from positioning the exterior wall 303 at a sufficient angle with respect to the rim 335 to allow the exterior wall 303 to be placed within the rim. The bottom plate 322 can, therefore, be provided with an angled or beveled rim 355, which helps assist in the assembly of the exterior wall 303. In particular, the angled rim 355 provides a higher point to which the exterior wall 303 can be placed over the bottom plate 322 first and then subsequently flexed around the lower points of the angled portion of the rim 355. When the exterior wall 303 is installed over the exterior liner 304, the bottom portion of the exterior wall 303 can be positioned within the bottom plate 322 over the angled rim 355. Once the exterior wall 303 is installed, the angled rim 355 holds the exterior wall 303 into place.

The casters 337 are configured to attach to the bottom plate 322 via an interference fit or snap fit connection to allow for an easy assembly. Specifically, as shown in FIG. 17D, which is a bottom view of the base plate 322, holes 359 can be provided in the bottom plate 322 for receiving the casters 337. The holes 359 can be dimensioned such that the casters 337 fit within the holes 359 by way of an interference fit. However, other types of connection methods are contemplated for securing the casters 337 to the bottom plate 322. For example, the casters could be connected to the bottom plate 322 by a threaded connection, a ball and socket connection, or a bayonet connection as well as other types of known connections in the art.

The exterior wall 303 is shown in FIG. 17E. The exterior wall 303 can be formed in as a rectangular sheet of material that is configured to roll up into a cylinder, by, for example, adding an adhesive to the strip or area 365 or by way of mechanical fastener and securing the area 365 to the opposite end. In this way, the exterior wall 303 can be formed of a flexible material such that the exterior wall 303 can be easy rolled up into a cylinder shape and can be flexed and collapsed into a smaller volume container for shipment. The exterior wall 303 can include holes 361, which when aligned, receive a drain pipe or tube 307. Additionally, the exterior wall 303 can include one or more notches 363 for aligning the exterior barrel wall with the bottom plate 322. Specifically, the notches 363 can align with the projections 366 on the bottom plate 322. The wall 303 may also include a graphic area 364 for printing any desired graphics, for example, a brand label, advertisement, price, logo, announcement, etc. It is also contemplated that the exterior wall 303 may also be extruded of a flexible material such that the exterior wall may be collapsible for shipment purposes.

FIG. 17F shows an exploded view of the inner liner 302 and the liner rim 306. As shown in FIGS. 17F and 17G, the inner liner 302 can be formed in a cylindrical shape. The inner liner 302 can be formed of a flexible plastic material that is substantially waterproof such that when ice is placed in the inner liner 302 water from the ice does not leak out of the inner liner 302. A layer of insulation material 367 can be placed on the bottom area of the inner liner 302 on the outside surface or on the inside surface of the inner liner 302 to help maintain the temperature of the inside of the inner liner 302. Additionally, insulation material can be placed at other areas along the inner liner 302 to help to maintain the temperature of the contents within the inner liner 302. The inner liner 302 may include a drain or an opening in the bottom of the inner liner 302, which can be connected to a drain pipe 307. A drain plug 384, as shown in FIG. 17F1, can be placed into the drain pipe 307 for selectively opening the drain pipe 307 to selectively control the water from the melted ice exiting the insulating device 301. The drain plug 384 can include a series of concentric rings 385 that are placed axially along a shaft of the drain plug 384. The drain plug 384 can also include a dome-shaped head 386, which includes a handle 386*a* and a series of axially extending ridges 387, which are configured to engage the exterior liner 304 and the exterior wall 303 to maintain the drain plug 384 in place on the outside of the insulating device 301.

FIG. 17F also illustrates how the inner liner 302 can be connected to the liner rim 306. In one example, the inner liner 302 can be connected to the liner rim 306 by heat staking. Specifically, several flanges 370 of the inner liner 302 that project outwardly from the top of the inner liner 302 can be sandwiched between the liner rim 306 and a series of strips 371, which form a circle around the inner liner 302. The flanges 370 can also include openings 372 that receive corresponding projections 373 in the strips 371. The projections 373 of the strips 371 are received in corresponding openings 374 in the liner rim 306. Each of the projections 373 can then be heated such that they deform to connect the inner liner 302 to the liner rim 306. Other techniques are contemplated for securing the inner liner 302 to the liner rim 306. For example, fasteners may be used in the place of the projections 373 and the heat staking method. In other examples, one or more of clips, ties, or straps as well as the other examples discussed herein could be used to secure the inner liner 302 to the liner rim 306.

FIG. 17G shows a top view of the liner rim 306. The liner rim 306 also includes notches 375 for receiving and securing the ends of the wires or rods 305. Additionally, liner rim 306 includes a series of slots 376 for receiving locking tabs 369 of the top rim 335. The slots 376 may also include a corresponding pin or engagement member for maintaining the locking tabs within the slots 376. The liner rim 306 can also include a pair of knuckles 377, which receive integral pins 378 on the lid 324 to form part of a hinge for the lid 324.

The top rim 335, which may also be referred to as a bezel, is shown in FIGS. 17H and 17I. FIG. 17H shows a top view of the top rim 335, and FIG. 17I shows a partial section of the top rim 335. The top rim 335 secures around the perimeter of the top of the insulating device 301, and generally provides a cover over the liner rim 306 of the inner liner 302. As shown in FIG. 17I, the top rim 335 can be provided with a series of locking tabs 369. The locking tabs 369 can be located on the inner perimeter of the top rim 335, and the locking tabs 369 can be configured to engage the slots 376 of the top rim 335. As shown in FIG. 17J, the locking tabs 369 can include an angled portion 369*a*, which can be configured to engage the underside of the slots 376 or an engagement member located within the slot 376 to help in securing the top rim 335 to the insulating device 301. In other examples, the top rim 335 can be provided with one or more of threads, pin and slot connections, ball and socket, or bayonet connections for securing the top rim 335 to the insulating device 301.

A top view of the lid 324 is shown in FIG. 17K. The lid 324 can include two pins 378 which can be received in the knuckles 377 located in the liner rim 306. In addition, the lid 324 can include an opening 379 for receiving a handle 388 such that the lid 324 can be easily lifted and rotated to retrieve the contents of the insulating device 301.

FIG. 17L shows a partial view of an example wire rod 305. The example wire rod 305 can be secured between the liner rim 306 and the bottom plate 322, and can be configured to prevent the expansion of the exterior liner 304. An example wire rod 305 can include a first coin shaped end 380*a* and a second coin shaped end 380*b*. The first coin shaped end 380*a* is configured to fit in the notches 375 of the liner rim 306, and the second coin shaped end 380*b* can be configured to fit in the notches 366 on the bottom plate 322. Therefore, due to the size of the first coin shaped end 380*a* being slightly larger than the notches 375 of the liner rim and the second coin shaped end 380*b* being slightly larger than the notches on the bottom plate 322, the wire rods 305 can be held in place on the insulating device 301.

The exterior liner 304 is further illustrated in FIGS. 17N and 17O. The exterior liner 304 can be formed of a rectangular sheet of material and in one example can be formed of a flexible and corrugated plastic material. Each end of the rectangular sheet can be secured together to form the exterior liner 304, for example, by an adhesive or one or more mechanical fasteners. Once assembled, the material forming the exterior liner 304 can be configured to withstand compression forces in the axial direction. The exterior liner 304 can include insulation material 381, which can be secured to the inside surface of the exterior liner 304 to provide insulation for the contents in the inner liner 302. The upper perimeter and the lower perimeter of the exterior liner 304 can be provided with location notches 383. The exterior liner 304 may also include a series of openings 389 for receiving the drain pipe 307 and plug 384 therein. It is also contemplated that the exterior liner 304 can be formed of an extruded piece of flexible material.

To assemble the insulating device 301, the casters 337 can be secured to the base plate 322, by placing the casters 337 into the holes 359 in the base plate 322. With the wheels of the casters 337 on the floor, the exterior liner 304 can then be placed onto the base plate 322. In one example, the exterior liner 304 can include indicators, e.g. numbers or letters, and the base plate 322 can include corresponding indicators 321, such that the user can properly align the exterior liner 304 with the base plate 322. The supports 308 can then be placed into the openings 319 of the base plate 322 for supporting the weight of the inner liner. The inner liner 302 can then be placed into the exterior liner 304, by aligning the drain pipe 307 with the opening 382 in the exterior liner 304. The wires or rods 305 can then be placed into the notches 375 of the liner rim 306 and then can be aligned with the inserts 366 of the base. The wires or rods 305 can then be locked into place by sliding the wires or rods 305 along each of the ramps formed on the inserts 366. The plug 384 can be placed into the drain pipe 307 to prevent the water from the ice from leaking out of the insulating device 301. The exterior wall 303 is then placed over the exterior liner 304 and then pushed into place along the bottom of the insulating device 301 such that it is pushed over the highest point of the beveled rim 355 of the base plate 322 and guided into position over the lower points of the beveled rim 355. Once the exterior wall 303 is in place, the top rim or bezel 335 can be locked into place using the locking tabs 369 to engage the slots 376 of the liner rim 306. The two pins 378 of the lid 324 can then be placed into the knuckles 377 located on the liner rim 306. The drain plug 384 can then be locked into place in the exterior liner 304 and the exterior wall 303. The insulating device 301 is also configured to be disassembled by reversing these assembly steps. For example, if it is desired to replace the graphic on the exterior wall, the exterior wall can be replaced with a new exterior wall having the new graphic.

A portable ice barrel can include an exterior barrel wall, an interior barrel wall, and insulative layer positioned in between the exterior barrel wall and the interior barrel wall. The interior barrel wall can comprise an expandable bladder made of flexible material and the expandable bladder can have an open end, a closed end, and can be adapted to expand from a collapsed position into an expanded position. In the expanded position, the expandable bladder can be configured to define an interior barrel cavity, the closed end can be configured to contain ice within the barrel cavity, and the open end can allow access to the barrel cavity. The exterior barrel wall can comprise a flexible sheet made of a semi-rigid material and the insulative material can comprise of a rigid expanded polystyrene foam material. The insulative material can be configured to provide structural support for the interior barrel wall. The expandable bladder can include a drain pipe having a drain pipe proximal end and a drain pipe distal end. The drain pipe proximal end can be secured to the closed end of the expandable bladder. The drain pipe can be configured such that the drain pipe distal end extends through the exterior barrel wall.

A top rim can be positioned over the barrel form so that the top rim encircles the form open end, and the top rim includes a top rim channel defined within the top rim. The expandable bladder can include a top drape extending from a perimeter of the open end of the expandable bladder. The top drape extending from a perimeter of the open end of the expandable bladder can be positioned in the top rim channel so that the top drape covers an inner surface of the channel. A top edge of the exterior barrel wall can be positioned in the top rim channel and on top of the top drape. The top drape of the expandable bladder can be secured proximate the top sheet edge of the exterior wall and at least a portion of the top drape of the expandable bladder can be draped over the top sheet edge of the exterior wall. The top rim can be secured to the top sheet edge of the exterior wall so that the portion of the top drape of the expandable bladder and a portion of the top edge of the exterior wall are positioned within the top rim channel.

In one example, the exterior barrel wall can be cylindrical and include an exterior wall outside surface, an exterior wall inside surface, an exterior wall top edge, and an exterior wall bottom edge. The expandable bladder includes a body segment extending between the open end and the closed end. The body segment of the expandable bladder can be cylindrical. The expandable bladder can also include a bladder interior surface and bladder exterior surface. The inner diameter of the body segment can be between about 18 inches to about 24 inches when the expandable bladder is in the expanded position and a diameter of the exterior barrel wall can be about 1 inch to about 5 inches greater than the diameter of the body segment.

A kit for components of a portable ice barrel can include an interior barrel wall made of an expandable bladder comprising a flexible material. The expandable bladder can have an open end and a closed end. The expandable bladder can be adapted to expand from a collapsed position into an expanded position. In the expanded position, the expandable bladder is configured to define a barrel cavity where the closed end is configured to contain ice within the barrel cavity and the open end is configured to allow access to the barrel cavity. The kit can also include a top rim, the top rim having a top rim channel defined therein; a bottom rim, the bottom rim having a bottom rim channel defined therein; a barrel lid configured to cover the open end; and a barrel base and at least one caster configured to be secured to the barrel base. The kit can include the expandable bladder having a drain pipe.

In one example, a method of assembling a portable ice barrel can include positioning an expandable bladder over a barrel form such that a bladder inner surface covers a form exterior surface. The bladder open end can be positioned proximate a form open end and a bladder closed end can be positioned proximate a form closed end. The expandable bladder can comprise of flexible material such that the expandable bladder is adapted to expand from a collapsed position into an expanded position. An exterior barrel wall can be positioned around the expandable bladder and covering the barrel form such that a gap is defined in between an inside surface of the exterior barrel wall and a bladder exterior surface. Insulative material can be inserted in the gap between the inside surface of the exterior barrel wall and the bladder exterior surface. The expandable bladder can be separated from the barrel form such that the expandable bladder is configured to define an interior barrel cavity and the closed end is configured to contain ice within the barrel cavity and the open end is configured to allow access to the barrel cavity. Inserting insulative material can include injecting expandable polystyrene foam material in the gap such that the expanded polystyrene foam material is configured to provide structural support for the interior barrel wall.

In one example, a top rim can be positioned over the barrel form so that the top rim encircles the form open end, and the top rim includes a top rim channel defined within the top rim. A top drape extending from a perimeter of the open end of the expandable bladder can be positioned in the top rim channel so that the top drape covers an inner surface of the channel. A top edge of the exterior barrel wall can be positioned in the top rim channel and on top of the top drape.

In another example, a portable ice barrel may include a plurality of sections which can be configured to form a cylindrical insulation layer. The cylindrical insulation layer can form an opening and an inner liner can extend into the opening of the cylindrical insulation layer to form an interior barrel cavity. A base of the portable ice barrel can include a grid formed by a series of supports, a disc, a rim, and a series of wheels. A top wall of the portable ice barrel can have an opening and a lid configured to cover the opening. The lid can also include a handle and an exterior barrel wall. The plurality of sections, the base, the top wall, the inner liner, and the exterior barrel wall can be configured to be assembled into a portable ice barrel. The plurality of sections, the base, the top wall, the inner liner, and the exterior barrel wall can be configured to be detached from one another and shipped in a container having flat configuration.

A plurality of clips can hold the inner liner onto the cylindrical insulation layer, and the top wall can be secured to the cylindrical insulation layer by a series of clips. The plurality of sections can include a series of fins which can be configured to trap air to provide thermal insulation.

In another example, a portable ice barrel kit may be provided. The kit may include a plurality of sections configured to form a cylindrical insulation layer. The cylindrical insulation layer can form an opening. The kit can be provided with a base which can include a plurality of flat sections that are configured to form a grid. The plurality of flat sections can include cutouts that can be aligned to form the grid. The base can also include a disc, a rim, and a series of wheels, and the series of wheels can be connected to the rim. The kit can also include a top wall which is formed with an opening and a lid configured to cover the opening. The kit may also include a container having flat configuration. The container can define a length, height, and width. The base, the top wall, the inner liner, the exterior barrel wall can be configured to be assembled into the portable ice barrel defining a diameter. The width of the container can be less than the diameter of the assembled portable ice barrel. The sections, the base, the top wall, the inner liner, and the barrel wall can be configured to be detached from one another and shipped in the container. The ratio of the height of the container to the diameter of the assembled portable ice barrel can range from 1 to 5 to 1 to 3.

The lid may also include a handle, and an inner liner, which is configured to extend into the opening of the cylindrical insulation layer to form an interior barrel cavity and an exterior barrel wall. A plurality of clips can be configured to hold the inner liner onto the cylindrical insulation layer, and a series of clips can be configured to secure the top wall to the cylindrical insulation layer. The plurality of sections can include a series of fins configured to trap air to provide thermal insulation.

In another example a method of assembly a portable ice barrel may include connecting a plurality of barrel sections using a tongue and groove connection to form an insulation layer, forming a series of supports into a grid, placing a disc and the support grid inside the insulation layer, holding the disc and the support grid in the barrel sections by securing the base rim to the barrel sections, securing the base rim to the barrel sections by aligning a series of tabs with holes, pulling and stretching the liner over the insulation layer holding the liner into place on the insulation layer by the clips, assembling a top wall and a partial top rim, securing a lid to the top wall, securing the top wall to the top of the barrel sections by a series of clips, and placing an exterior barrel wall around the barrel sections.

In another example, a portable ice barrel may include a plurality of sections which can be configured to form a cylindrical insulation layer. The cylindrical insulation layer can form an opening and an inner liner can extend into the opening of the cylindrical insulation layer to form an interior barrel cavity. A base of the portable ice barrel can include a grid formed by a series of supports, a disc, a rim, and a series of wheels. A top wall of the portable ice barrel can have an opening and a lid configured to cover the opening. The lid can also include a handle and an exterior barrel wall. The plurality of sections, the base, the top wall, the inner liner, and the exterior barrel wall can be configured to be assembled into a portable ice barrel. The plurality of sections, the base, the top wall, the inner liner, and the exterior barrel wall can be configured to be detached from one another and shipped in a container having flat configuration.

In another example, a portable ice barrel may include a section which can be configured to form a cylindrical insulation layer. The cylindrical insulation layer can form an opening and an inner liner can extend into the opening of the cylindrical insulation layer to form an interior barrel cavity. A collapsible base of the portable ice barrel can include a grid formed by a series of supports, a disc, a bottom rim, and a series of wheels or optionally, the collapsible base may include support tubes in place of the grid. A collapsible top rim can have an opening and a lid configured to cover the opening. The collapsible lid can also include a handle and an exterior barrel wall. The base, the top wall, the inner liner, and the exterior barrel wall can be configured to be assembled into a portable ice barrel. An optional exterior liner can be configured to fit in between the inner liner and the exterior barrel wall. The optional exterior liner, the top wall, the inner liner, and the exterior barrel wall can be configured to be detached from one another, collapsed, and shipped in a container having flat configuration. The exterior wall and optional exterior liner, when detached from the other components, resemble a flexible sheet of rigid material. The sheets can then be rolled into a cylinder, or other shape, upon configuring the components of the portable ice barrel.

In another example, a collapsible insulating device can include a base, an inner liner defining an interior cavity, an opening extending into the inner liner, and a layer covering the inner liner. The base, the inner liner, and the layer can be configured to be assembled into the insulating device. The base, the inner liner, and the layer can be configured to be detached from one another and placed into a container. The interior cavity can define a volumetric capacity in the assembled insulating device, and the volumetric capacity of the insulating device can be larger than a volume of the container. A ratio of a volumetric capacity of interior cavity to a volume of the container can be between 2:1 to 4:1. The container may define a length, height, and width, and the width of the container is less than a diameter of the assembled insulating device. A ratio of the width of the container to the diameter of the assembled insulating device ranges from 1 to 5 to 1 to 3. The layer can be an insulation layer, and the layer can be formed of flexible corrugated plastic. The base may include a plate, at least one tube for supporting the weight of the inner liner, and a series of wheels. The insulating device may include a top wall, and the top wall may include a lid configured to cover the opening. The lid may also include a handle. The insulating device may also include an exterior wall, and the base may include an angled portion to allow for assembly of the exterior wall to the insulating device. The insulating device may also include at least one rod extending from the base to the top wall, and a drain pipe. The base may also include indicators such that the user can properly align the layer with the base. The inner liner may define a bottom surface, and the bottom surface may include an insulation layer.

In another example, a collapsible insulating device kit can include a base, an inner liner forming an interior cavity defining a volumetric storage capacity, an opening extending into the inner liner, a layer covering the inner liner, an exterior wall, and a container defining a length, height, width, and volume. The base, the inner liner, the layer, and the exterior wall can be configured to be assembled into an insulating device. The volume of the container can be less than the volumetric storage capacity. The base, the inner liner, the layer, and the exterior wall can be configured to be detached from one another and placed into the container. The container can define a height, length and width, and the height can be greater than the length. The length can be greater than the width, and a diameter of the assembled insulating device can be greater than the width. A ratio of the width of the container to the diameter of the assembled insulating device can range from 1 to 5 to 1 to 3. A ratio of the volumetric storage capacity of the inner liner to the volume of the container can be configured to be between 2:1 to 4:1. The base can include a plurality of supports extending toward the inner liner for supporting the inner liner. The insulating device may also include a top wall having a lid which can be configured to cover the opening, and the lid may include a handle. At least one rod can be configured to interconnect the top wall and the base. The layer can be an insulation layer. The inner liner may define a bottom surface and the bottom surface may include an insulation layer. The base may include an angled portion to allow for the assembly of the exterior wall to the insulating device.

The example collapsible containers of the instant disclosure can provide for optimized shipping, use, and assembly of the portable ice barrel according to methods disclosed herein. For example, in an embodiment, components of the portable ice barrel are shipped to an assembly location located in the vicinity of the point of use. In an embodiment, a kit which includes the expandable bladder in the collapsed position is shipped to an assembly location. In an embodiment, the kit includes the expandable bladder in the collapsed position, the top rim, the bottom rim, the lid, the barrel base, and casters. In an embodiment, the assembly location includes flexible sheets with which to form the exterior barrel wall as described above. In an embodiment, the assembly location includes facilities to print graphics on the outside surface of the sheet as described above. In an embodiment, the assembly location can include the insulative material. In an embodiment, the assembly location includes a machine and material for injecting polystyrene foam during assembly of the portable ice barrel as described above. In an embodiment, the barrel form, flexible sheets, insulative material, and/or machine for injecting insulative material can be shipped to the assembly location.

The methods of shipping, use, and assembly disclosed herein provide several advantages over conventional methods used for conventional ice barrels. For example, conventional ice barrels are often shipped fully assembled to the point of use from a distant location. This results in wasted resources from shipping air in the interior cavity of the barrel. For example, often times, the cost of shipping the fully assembled conventional barrel is greater than the cost of the barrel itself. In addition, conventional ice barrels include injection molded interior walls which add to the weight of the barrel as compared to the portable barrel with expandable bladder disclosed herein. The reduced weight of the portable ice barrel disclosed herein provides efficiencies, for example, in shipping costs and ease of use. Users of conventional barrels often turn the barrel over to empty water from the interior cavity, which can lead to injury due to the weight of the barrel. The reduced weight of the portable barrel of the instant disclosure can, for example, reduce instances of injury from turning the barrel over.

The examples discussed herein proves for a lower cost unit, which can be easy shipped, assembled and disassembled at its final location. This may help companies who purchase coolers a tremendous amount of freight cost which, depending the shipping destination could actually exceed the cost of the entire unit itself. Printing outfits around the country in major metropolitan areas can print large, wrap around graphics for the particular region. For example, a printer in Los Angeles would print graphic wraps for the Dodgers, Angels, and Kings in addition to any other regionalized need. The printer would then assemble the coolers with those wraps and ship them out locally at a lower cost.

The present disclosure and the accompanying drawings make reference to a variety of examples. The purpose served by the disclosure, however, is to provide examples of the various features and concepts related to the portable ice barrel of the instant disclosure, not to limit the scope of the disclosure to the examples. One skilled in the relevant art will recognize that numerous variations and modifications may be made to the examples described above without departing from the scope of the subject matter disclosed herein.

What is claimed is:

1. A collapsible insulating device comprising:

a base;

an inner liner defining an interior cavity;

an opening extending into the inner liner; and a layer covering the inner liner; and wherein the base, the inner liner, and the layer are configured to be assembled into the insulating device, wherein the base, the inner liner, and the layer are configured to be detached from one another and placed into a container, wherein the interior cavity defines a volumetric capacity in the assembled insulating device and wherein the volumetric capacity of the insulating device is configured to be larger than a volume of the container.

2. The collapsible insulating device of claim 1 wherein the layer is an insulation layer.

3. The collapsible insulating device of claim 2 wherein the layer is formed of flexible corrugated plastic.

4. The collapsible insulating device of claim 1 wherein the container defines a length, height, and width, wherein the width of the container is less than a diameter of the assembled insulating device.

5. The collapsible insulating device of claim 4 wherein a ratio of the width of the container to the diameter of the assembled insulating device ranges from 1 to 5 to 1 to 3.

6. The collapsible insulating device of claim 1 wherein a ratio of a volumetric capacity of the interior cavity to a volume of the container is configured to be between 2:1 to 4:1.

7. The collapsible insulating device of claim 1 wherein the base comprises a plate, at least one tube for supporting the weight of the inner liner, and a series of wheels.

8. The collapsible insulating device of claim 1 further comprising a top wall, wherein the top wall comprises a lid configured to cover the opening, the lid further comprising a handle.

9. The collapsible insulating device of claim 1 further comprising an exterior wall and wherein the base comprises an angled portion to allow for assembly of the exterior wall to the insulating device.

10. The collapsible insulating device of claim 8 further comprising at least one rod extending from the base to the top wall.

11. The collapsible insulating device of claim 1 further comprising a drain pipe.

12. The collapsible insulating device of claim 1 wherein the base further comprises indicators such that a user can properly align the layer with the base.

13. The collapsible insulating device of claim 1 wherein the inner liner defines a bottom surface and wherein the bottom surface includes an insulation layer.

14. A collapsible insulating device kit comprising:

a base;

an inner liner forming an interior cavity defining a volumetric storage capacity;

an opening extending into the inner liner;

a layer covering the inner liner;

an exterior wall; and a container defining a length, height, width, and volume;

wherein the base, the inner liner, the layer, and the exterior wall are configured to be assembled into an insulating device;

wherein the volume of the container is less than the volumetric storage capacity;

wherein the base, the inner liner, the layer, and the exterior wall are configured to be detached from one another and placed into the container.

15. The kit of claim 14 wherein the container height is greater than the length and the length is greater than the width, and wherein a diameter of the assembled insulating device is greater than the width.

16. The kit of claim 15 wherein a ratio of the width of the container to the diameter of the assembled insulating device ranges from 1 to 5 to 1 to 3.

17. The kit of claim 14 wherein a ratio of the volumetric storage capacity of the inner liner to the volume of the container is configured to be between 2:1 to 4:1.

18. The kit of claim 14 wherein the base comprises a plurality of supports extending toward the inner liner for supporting the inner liner.

19. The kit of claim 14 further comprising a top wall having a lid configured to cover the opening, the lid further comprising a handle.

20. The kit of claim 19 further comprising at least one rod configured to interconnect the top wall and the base.

21. The kit of claim 14 wherein the layer is an insulation layer.

22. The kit of claim 14 wherein the inner liner defines a bottom surface and wherein the bottom surface includes an insulation layer.

23. The kit of claim 14 wherein the base comprises an angled portion to allow for the assembly of the exterior wall to the insulating device.

* * * * *